US009795275B2

(12) United States Patent
Hahm et al.

(10) Patent No.: US 9,795,275 B2
(45) Date of Patent: Oct. 24, 2017

(54) DISHWASHER

(71) Applicant: SAMSUNG ELECTRONICS CO., LTD., Suwon-si, Gyeonggi-do (KR)

(72) Inventors: Jung Yoon Hahm, Yongin-si (KR); Ki Sup Lee, Seongnam-si (KR); In Chul Yun, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/688,135

(22) Filed: Apr. 16, 2015

(65) Prior Publication Data

US 2015/0342441 A1 Dec. 3, 2015

(30) Foreign Application Priority Data

May 30, 2014 (KR) ..... 10-2014-0065725

(51) Int. Cl.
*F26B 21/06* (2006.01)
*A47L 15/48* (2006.01)

(52) U.S. Cl.
CPC ..... *A47L 15/481* (2013.01); *A47L 15/483* (2013.01); *A47L 15/486* (2013.01); *A47L 15/488* (2013.01)

(58) Field of Classification Search
CPC ..... F26B 21/00; F26B 21/06; F26B 23/00; F26B 25/00; A47L 15/00; A47L 15/481; A47L 15/483; A47L 15/486; B08B 3/00; B08B 3/04; B08B 5/00; B08B 13/00
USPC ..... 34/60, 80, 86, 90, 79; 15/104.9; 134/58 D, 200
See application file for complete search history.

(56) References Cited

U.S. PATENT DOCUMENTS 3,402,576 A * 9/1968 Krupsky ..... A47L 15/0097 134/111
6,823,878 B1 * 11/2004 Gadini ..... A47L 15/4229 134/109
7,103,992 B2 * 9/2006 Duden ..... A47L 15/4291 134/102.3
7,347,005 B2 * 3/2008 Cerruti ..... A47L 15/486 134/95.2
7,367,134 B2 * 5/2008 Osvatic ..... D06F 58/20 137/514
8,601,716 B2 * 12/2013 Jerg ..... A47L 15/481 34/329

(Continued)

FOREIGN PATENT DOCUMENTS

CH 2286708 A2 * 2/2011 ..... A47L 15/4291
DE 102005004089 A1 * 6/2006 ..... A47L 15/4285

(Continued)

OTHER PUBLICATIONS

European Office Action dated Jan. 20, 2017 in corresponding European Patent Application No. 15166602.1.

*Primary Examiner* — Stephen M Gravini
(74) *Attorney, Agent, or Firm* — Staas & Halsey LLP

(57) ABSTRACT

Disclosed herein is a dishwasher having a structure capable of reducing energy consumption, and improving drying performance. The dishwasher includes a body, a washing tub provided inside the body and a drying unit in which a dehumidifying member is rotatably accommodated, wherein the dehumidifying member may include a dehumidifying area and a regenerating area separated from the dehumidifying area to perform dehumidifying and regenerating concurrently.

18 Claims, 21 Drawing Sheets

(56) References Cited

U.S. PATENT DOCUMENTS

| | | | | |
|---|---|---|---|---|
| 8,869,424 | B2 * | 10/2014 | Hermann | A47L 15/0034<br>134/107 |
| 8,904,667 | B2 * | 12/2014 | Sauerbeck | A47L 15/0042<br>34/263 |
| 9,167,951 | B2 * | 10/2015 | Kumar | A47L 15/4291 |
| 2008/0127997 | A1 * | 6/2008 | Jerg | A47L 15/4285<br>134/10 |
| 2015/0342441 | A1 * | 12/2015 | Hahm | A47L 15/481<br>34/79 |

FOREIGN PATENT DOCUMENTS

| | | | | | |
|---|---|---|---|---|---|
| EP | 2949258 | A1 * | 12/2015 | | A47L 15/481 |
| JP | 4414841 | B2 | 3/2006 | | |
| JP | 2010-94247 | | 4/2010 | | |
| KR | 10-0811095 | | 3/2008 | | |
| KR | 10-1311269 | | 5/2013 | | |
| KR | 20130087849 | A * | 8/2013 | | |
| KR | 20150026191 | A * | 3/2015 | | A47L 15/481 |
| TR | WO 2011080113 | A1 * | 7/2011 | | A47L 15/4217 |
| TR | WO 2012062666 | A1 * | 5/2012 | | A47L 15/481 |

* cited by examiner

DISHWASHER

CROSS-REFERENCE TO RELATED APPLICATIONS

This application claims the benefit of Korean Patent Application No. 10-2014-0065725, filed on May 30, 2014 in the Korean Intellectual Property Office, the disclosure of which is incorporated herein by reference.

BACKGROUND

1. Field

One or more embodiments of the present disclosure relate to a dishwasher, more particularly to a dishwasher having a structure capable of reducing energy consumption and improving drying performance.

2. Description of the Related Art

In general, more home appliances are being configured to have a drying function, such as a dishwasher, a washing machine, a clothes dryer and the like. A dishwasher has a drying function to remove wash water remaining on dishware after the completion of a washing, and a washing machine and a clothes dryer have a drying function to dry wet clothes.

For example, a dishwasher is configured to wash dishware sanitarily and efficiently, and washes dirty dishware and dries washed dishware. A drying cycle in the dishwasher is configured to remove moisture from washed dishware. The drying cycle includes warming dishware by increasing a temperature of water sprayed to the dishware during a last washing cycle, evaporating water remaining on the dishware, and removing water by condensing water vapor in a cooling duct disposed on the inside or the outside of a washing tub or by absorbing water vapor with a desiccant.

When using a desiccant for removal of water vapor, the regeneration process of drying the desiccant is required to allow the desiccant to absorb moisture during the drying cycle. Conventionally, a method of heating the desiccant by a heater during a washing cycle or a rinsing cycle is used. By heating the desiccant with the heater, moisture is removed from the desiccant so that regeneration of the desiccant is performed, and the regenerated desiccant is allowed to absorb water again during a drying cycle.

In general, as for a dishwasher, desiccant porous is used, and water vapor absorbed into the desiccant porous is accommodated in a liquid or gaseous state. In order to regenerate the desiccant porous, energy, that is, evaporation heat, is required to change water contained in the pores into steam, and additional energy also is required to allow water vapor to escape from the pores. Thus, for the regeneration of the desiccant, large amount of energy is required so there is a problem that energy consumption increases.

SUMMARY

Therefore, it is an aspect of the present disclosure to provide a dishwasher having structure capable of increasing drying area by using rotatable dehumidifying member.

It is another aspect of the present disclosure to provide a dishwasher having structure capable of reducing energy consumption by performing dehumidifying and regenerating at the same time.

It is another aspect of the present disclosure to provide a dishwasher having structure capable of reducing a drying time of dishware.

It is another aspect of the present disclosure to provide a dishwasher having structure capable of preventing dishware from being damaged during a drying cycle at a high temperature.

Additional aspects of the present disclosure will be set forth in part in the description which follows and, in part, will be obvious from the description, or may be learned by practice of the invention.

In accordance with an aspect of the present disclosure, a dishwasher includes a body, a washing tub provided inside the body and a drying unit in which a dehumidifying member is rotatably accommodated, wherein the dehumidifying member may include a dehumidifying area and a regenerating area separated from the dehumidifying area to perform dehumidifying and regenerating simultaneously.

The dishwasher may further include an intake duct coupled to the outer surface of the washing tub and provided with an inlet to allow air inside the washing tub to be introduced so that air inside the washing tub is transferred to the dehumidifying area, wherein the drying unit may include a blowing duct connected to the intake duct, and air discharged from the intake duct may be transferred to a dehumidifying fan disposed inside the blowing duct.

The drying unit may further include a condensing duct connected to the blowing duct and configured to accommodate a condenser inside the condensing duct, wherein air passed through the dehumidifying fan may be transferred to the dehumidifying area by passing through the condenser in a first direction (A) toward an upper side of the washing tub.

The dishwasher may further include a discharge duct connected to an outer surface of the washing tub and provided with an outlet to allow air passed through the dehumidifying area to be discharged to the inside of the washing tub, wherein the drying unit may further include a drying duct connected to the discharge duct and configured to rotatably accommodate the dehumidifying member.

The drying duct may include a casing disposed on an upper portion of the condensing duct and configured to accommodate the dehumidifying member and a rotation transmitting device of the dehumidifying member, and a discharge channel configured to connect the discharge duct to the casing and provided with a partition extended toward the dehumidifying member to divide the dehumidifying member into the dehumidifying area and the regenerating area.

The rotation transmitting device of the dehumidifying member may include a dehumidifying member frame disposed on an outer circumference of the dehumidifying member and integrally rotated with the dehumidifying member, and a rotation gear coupled to the dehumidifying member frame to transfer torque to the dehumidifying member and coupled to the outside of the discharge channel, wherein tooth may be formed on an outer surface of the dehumidifying member frame so that the dehumidifying member frame and the rotation gear may be engaged to be rotated.

The drying unit may further include a heating duct disposed between the drying duct and the condensing duct, wherein the heating duct may accommodate a heater having a shape corresponding to the regenerating area to apply heat to the regenerating area.

The blowing duct may include an net channel configured to accommodate the dehumidifying fan and connecting the intake duct to the condensing duct, wherein the net channel may form a dehumidifying flow path by being connected to the condensing duct so that air introduced through the net may be discharged to the inside of the washing tub through the outlet by passing the dehumidifying member.

The blowing duct may further include a first channel configured to accommodate the dehumidifying fan and coupled to the outside of the net channel to be connected to the heating duct and a second channel coupled to the outside of the first channel to form a regenerating flow path with the first channel.

Air passed through the first channel may be transferred to the regenerating area by passing through the heater to regenerate the dehumidifying member.

The drying unit may further include a connecting channel configured to form the regenerating flow path by connecting the drying duct to the condensing duct.

Air transferred to the regenerating area may pass through the condenser in a second direction (B) perpendicular to the first direction (A) by passing through the connecting channel.

The condensing duct may include a return channel formed along an edge of the condensing duct to provide a plurality of slit on surface facing to the condenser and configured to connect the connecting channel to the second channel, wherein air passed through the condenser in the second direction (B) may be introduced to the first channel through the return channel by passing the second channel.

The dehumidifying flow path and the regenerating flow path may form a closed flow path, respectively.

A driving device may be mounted to the outside of the second channel, and the dehumidifying fan and the regenerating fan may be connected to the driving device to be integrally rotated.

An area of the regenerating area may be less than 50% of a total area of the dehumidifying member.

The dehumidifying member may have a porous honeycomb structure (Honeycomb) shape to secure spacious dehumidifying area.

In accordance with another aspect of the present disclosure, a dishwasher includes a body, a washing tub provided inside the body, a desiccant wheel provided inside the body to be disposed outside of the washing tub and having a porous structure to secure spacious dehumidifying area, a dehumidifying flow path allowing air inside the washing to be circulated, and a regenerating flow path separated from the dehumidifying flow path and allowing air regenerating the desiccant wheel to be circulated, wherein the desiccant wheel may include a dehumidifying area formed on the dehumidifying flow path, and a regenerating area formed on the regenerating flow path to be separated from the dehumidifying area.

The dehumidifying flow path and the regenerating flow path may form a closed flow path, respectively.

An area of the regenerating area may be less than 50% of a total area of the desiccant wheel.

The dishwasher may further include a heater disposed on the regenerating flow path to be adjacent to the regenerating area and having a shape corresponding to the regenerating area.

The dishwasher may further include a condenser in which the dehumidifying flow path and the regenerating flow path may be crossed to exchange heat between air circulating in the dehumidifying flow path and air circulating in the regenerating flow path.

The condenser may be accommodated inside a condensing duct provided with a drain pipe disposed on one side thereof, wherein the condenser may be tilted toward the drain pipe so that condensate water generated in the condenser may be smoothly discharged.

The dehumidifying flow path may pass through the condenser in a first direction (A), and the regenerating flow path may pass through the condenser in a second direction (B) perpendicular to the first direction (A), separately from the dehumidifying flow path, to prevent air circulating in the dehumidifying flow path and air circulating in the regenerating flow path from being mixed.

The dishwasher may further include a fan configured to supply driving force to allow air inside washing tub to be circulated along the dehumidifying flow path and to allow air regenerating the desiccant wheel to be circulated along the regenerating flow path, wherein the fan may include a dehumidifying fan formed on the dehumidifying flow path and a regenerating fan formed on the regenerating flow path and having a smaller thickness than that of the dehumidifying fan.

The dehumidifying fan and the regenerating fan may be integrally rotated with respect to the same driving shaft.

The heater may be accommodated inside the heating duct, wherein the heating duct may include heat-durable plastics.

The heating duct adjacent to the heater may include stainless steel.

A diameter of the desiccant wheel may be 50 mm or larger than 50 mm and 40 mm or smaller than 40 mm.

A required time per one rotation of the desiccant wheel may be four minutes or less than four minutes.

In accordance with another aspect of the present disclosure, a dishwasher includes a washing tub and a rotatable dehumidifying member configured to dehumidify air received from an interior of the washing tub using a desiccant and to regenerate the desiccant.

The rotatable dehumidifying member is wheel shaped and includes a dehumidifying area and a regenerating area, separate from the dehumidifying area, so that the dehumidifying member is configured to perform dehumidifying and regenerating concurrently.

The rotatable dehumidifying member is regenerated in the regenerating area by a heater to prevent the rotatable dehumidifying member from becoming saturated with water.

The rotatable dehumidifying member may be comprised of a polymer.

The rotatable dehumidifying member has a porous honeycomb configuration to secure a spacious dehumidifying area.

In accordance with another aspect of the present disclosure, drying unit to be provided inside a dishwasher is described. The drying unit includes a rotatable dehumidifying member having a porous structure, a dehumidifying flow path allowing air inside the dishwasher to be dehumidified, and a regenerating flow path separated from the dehumidifying flow path and allowing air for regenerating the rotatable dehumidifying member to be circulated.

The rotatable dehumidifying member comprises a dessicant wheel having a dehumidifying area and a regenerating area separated from the dehumidifying area.

The dehumidifying area is formed on the dehumidifying flow path and the regenerating area is formed on the regenerating flow path.

The dehumidifying flow path and the regenerating flow path are crossed with each other to exchange heat between air circulating in the dehumidifying flow path and air circulating in the regenerating flow path.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
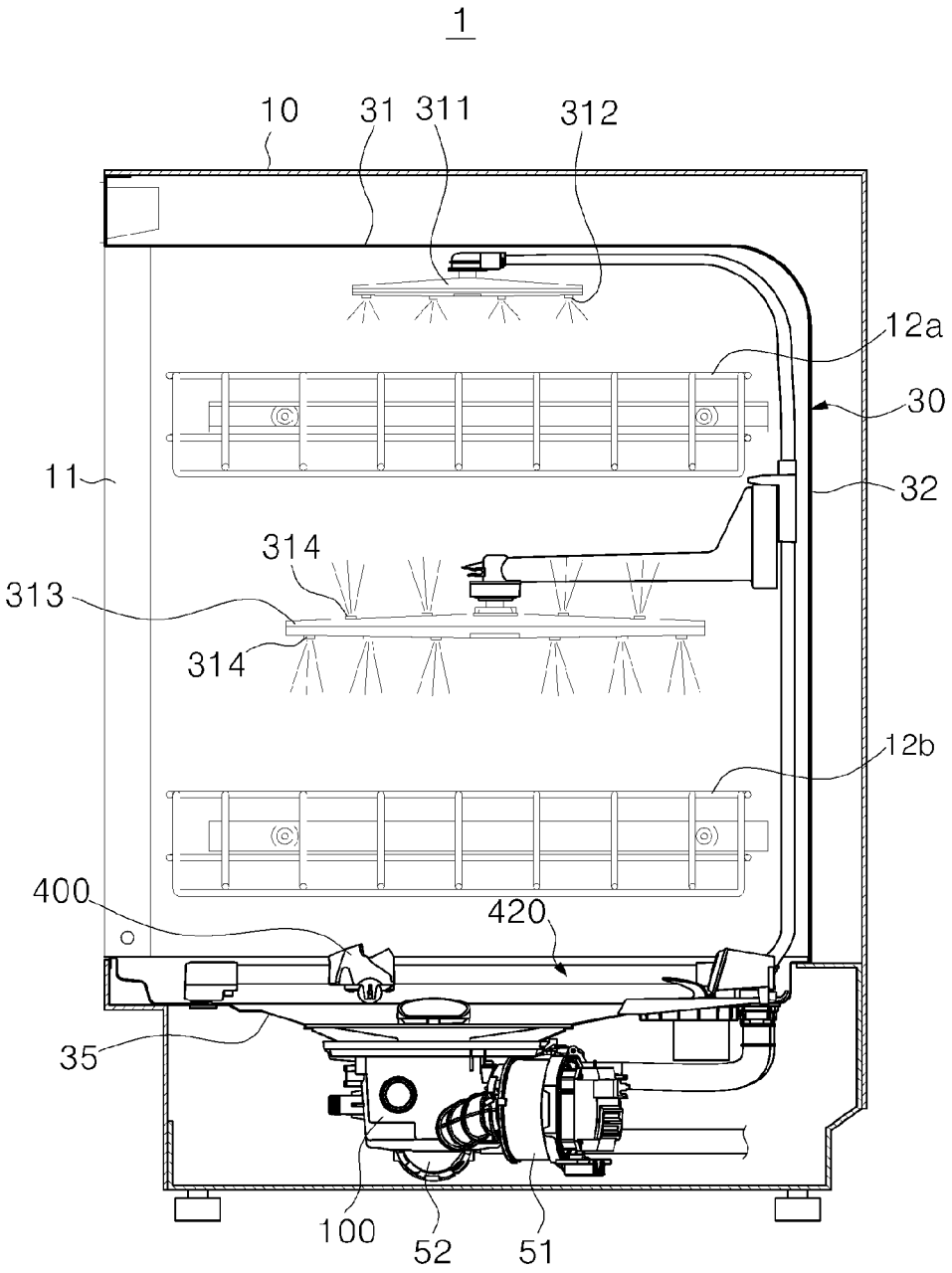
FIG. 1 is a schematic cross-sectional view illustrating a dishwasher in accordance with one embodiment of the present disclosure.

Reference will now be made in detail to embodiments of the present disclosure, examples of which are illustrated in the accompanying drawings, wherein like reference numerals refer to like elements throughout.

Terms used in the following description "front end", "rear end", "upper portion", "lower portion" "upper end" and "lower end", will be defined with reference to the drawings, and shapes and positions of each component are not limited by the terms.

Figure 2:
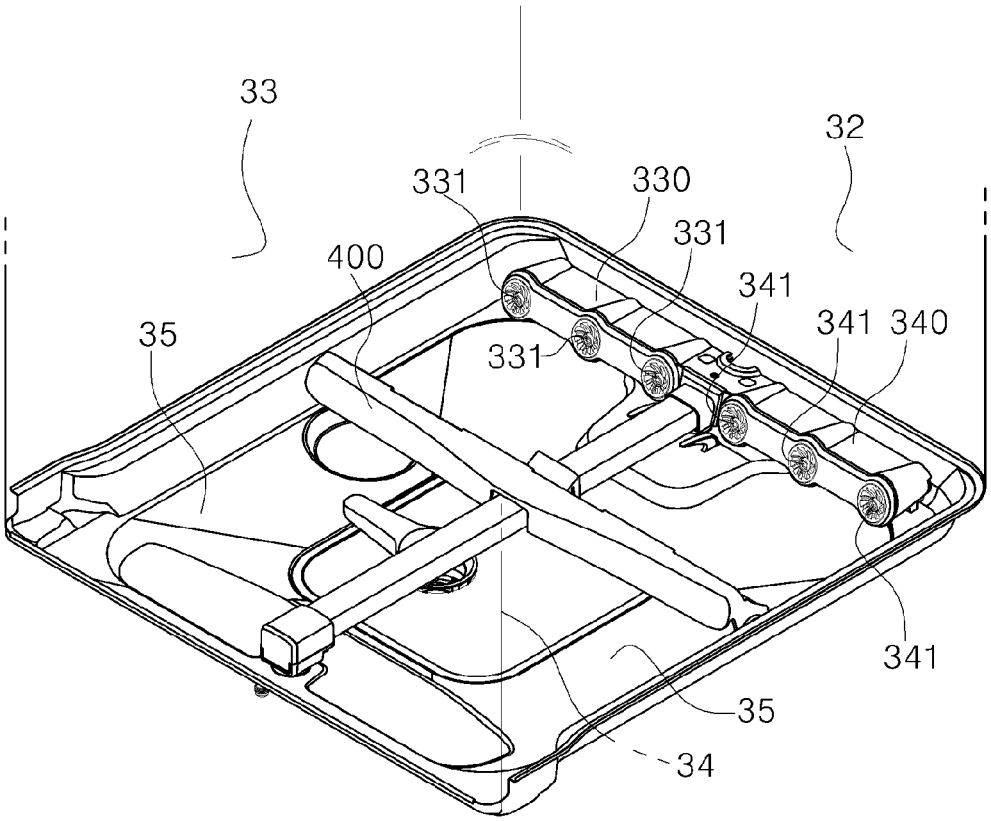
FIG. 2 is a view illustrating a lower portion of the dishwasher of FIG. 1.

FIG. 1 is a schematic cross-sectional view illustrating a dishwasher in accordance with one embodiment of the present disclosure, and FIG. 2 is a view illustrating a lower portion of the dishwasher of FIG. 1.

As illustrated in FIGS. 1 and 2, a dishwasher 1 includes a body 10 forming an external appearance, a washing tub 30 installed inside the body 10, baskets 12*a* and 12*b* installed inside the washing tub 30 storing dishware, nozzles 311, 313, 330, and 340 spraying wash water, a sump 100 storing wash water, a circulating pump 51 supplying wash water to the nozzles 311, 313, 330, and 340 by pumping wash water stored in the sump 100, a drain pump 52 discharging wash water with food debris to the outside, a vane 400 pushing wash water to dishware while moving in the washing tub 30, and a driving device 420 driving the vane 400.

The washing tub 30 may be formed in a shape of a box having an opening on a front side thereof to insert or withdraw dishware. The opening on the front side of the washing tub 30 may be opened or closed by a door 11. The washing tub 30 may include an inner upper surface 31, an inner rear surface 32, an inner left surface 33, an inner right surface 34, and a bottom surface 35.

The baskets 12*a* and 12*b* may be a wire rack consisting of wires so that wash water flows without remaining or accumulating within the basket. The baskets 12*a* and 12*b* may be detachably installed in the washing tub 30. The baskets 12*a* and 12*b* may include an upper basket 12*a* disposed on an upper portion of the washing tub 30 and a lower basket 12*b* disposed on a lower portion of the washing tub 30.

The nozzles 311, 313, 330, and 340 may wash dishware by spraying wash water with high pressure. The nozzles 311, 313, 330, and 340 may include a rotating nozzle 311 disposed on an upper portion of the washing tub 30, a center rotating nozzle 313 disposed on a center portion of the washing tub 30, and fixed nozzles 330 and 340 fixed to a lower portion of the washing tub 30.

The upper rotating nozzle 311 is disposed at an upper portion of the upper basket 12*a* and sprays wash water downward while rotating by water pressure. For this, spraying holes 312 may be disposed at a lower end of the upper rotating nozzle 311. The upper rotating nozzle 311 may directly spray wash water to dishware stacked on the upper basket 12*a*.

The center rotating nozzle 313 is disposed between the upper basket 12*a* and the lower basket 12*b* and sprays wash water upward and downward while rotating by water pressure. For this, spraying holes 314 may be disposed an upper end and a lower end of the center rotating nozzle 313. The center rotating nozzle 313 may directly spray wash water to dishware stacked on the upper basket 12*a* and the lower basket 12*b*.

The fixed nozzles 330 and 340 are provided to be immobile in contrast with the rotating nozzles 311 and 313, and are fixed to one side of the washing tub 30. The fixed nozzles 330 and 340 may be approximately disposed adjacent to the inner rear surface 32 of the washing tub 30 to spray wash water toward the front. Therefore, wash water from the fixed nozzles 330 and 340 may not directly reach dishware.

Sprayed wash water from the fixed nozzles 330 and 340 may pushed toward dishware by the vane 400. The fixed nozzles 330 and 340 may be disposed under the lower basket 12*b*. The vane 400 may push wash water sprayed from the fixed nozzles 330 and 340 toward an upper side. That is, wash water sprayed from the fixed nozzles 330 and 340 may be pushed toward dishware stacked on the lower basket 12*b* by the vane 400.

The fixed nozzles 330 and 340 may include a plurality of spraying holes 331 and 341 arranged in a left and right direction of the washing tub 30, respectively. The plurality of spraying holes 331 and 341 may spray wash water toward the front.

The vane 400 may be extended in the left and right direction of the washing tub 30 to push wash water sprayed from the plurality of spraying holes 331 and 341 of the fixed nozzles 330 and 340. That is, one end portion of a longitudinal direction of the vane 400 may be adjacent to the inner left surface 33 and the other end portion of a longitudinal direction of the vane 400 may be adjacent to the inner right surface 34.

The vane 400 may perform a linear reciprocating motion along a spray direction of wash water sprayed from the fixed nozzles 330 and 340. That is, the vane 400 may perform a linear reciprocating motion in a direction from back to front of the washing tub 30.

In comparison with a rotating nozzle spraying wash water within a turning radius thereof, a leaner spray structure which includes the fixed nozzles 330 and 340 and the vane 400 may allow the washing tub 30 to be cleaned without blind spot.

The fixed nozzles 330 and 340 may include a left fixed nozzle 330 disposed on a left side of the washing tub 30 and a right fixed nozzle 340 disposed on a right side of the washing tub 30.

The rotating nozzles 311 and 313, and the fixed nozzles 330 and 340 may separately spray wash water. In addition, the left fixed nozzle 330 and the right fixed nozzle 340 may separately spray wash water.

Wash water sprayed from the left fixed nozzle 330 may reach only the left area of the washing tub 30 by the vane 400 and wash water sprayed from the right fixed nozzle 340 may reach only the right area of the washing tub 30 by the vane 400.

Therefore, the dishwasher may separately wash the left and right side of the washing tub 30. According to one embodiment of the present disclosure, a dishwasher performing washing by dividing into the left and right side is described, but is not limited thereto. Dividing into numerous sides may be achieved, as needed.

After the completion of a washing cycle, a drying cycle is proceeded to remove wash water remaining in the washing tub 30.

Figure 3:
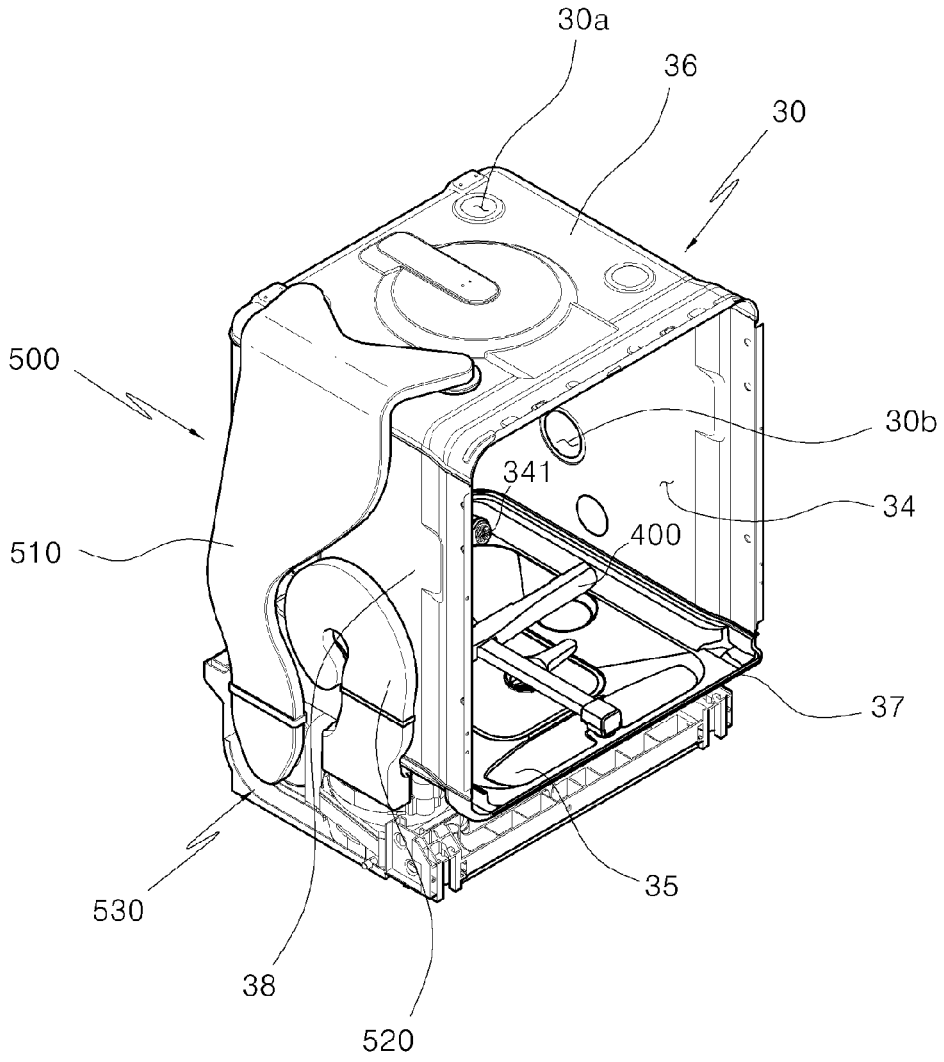
FIG. 3 is a view illustrating a state in which a drying assembly is coupled to a washing tub of the dishwasher in accordance with one embodiment of the present disclosure.
Figure 4:
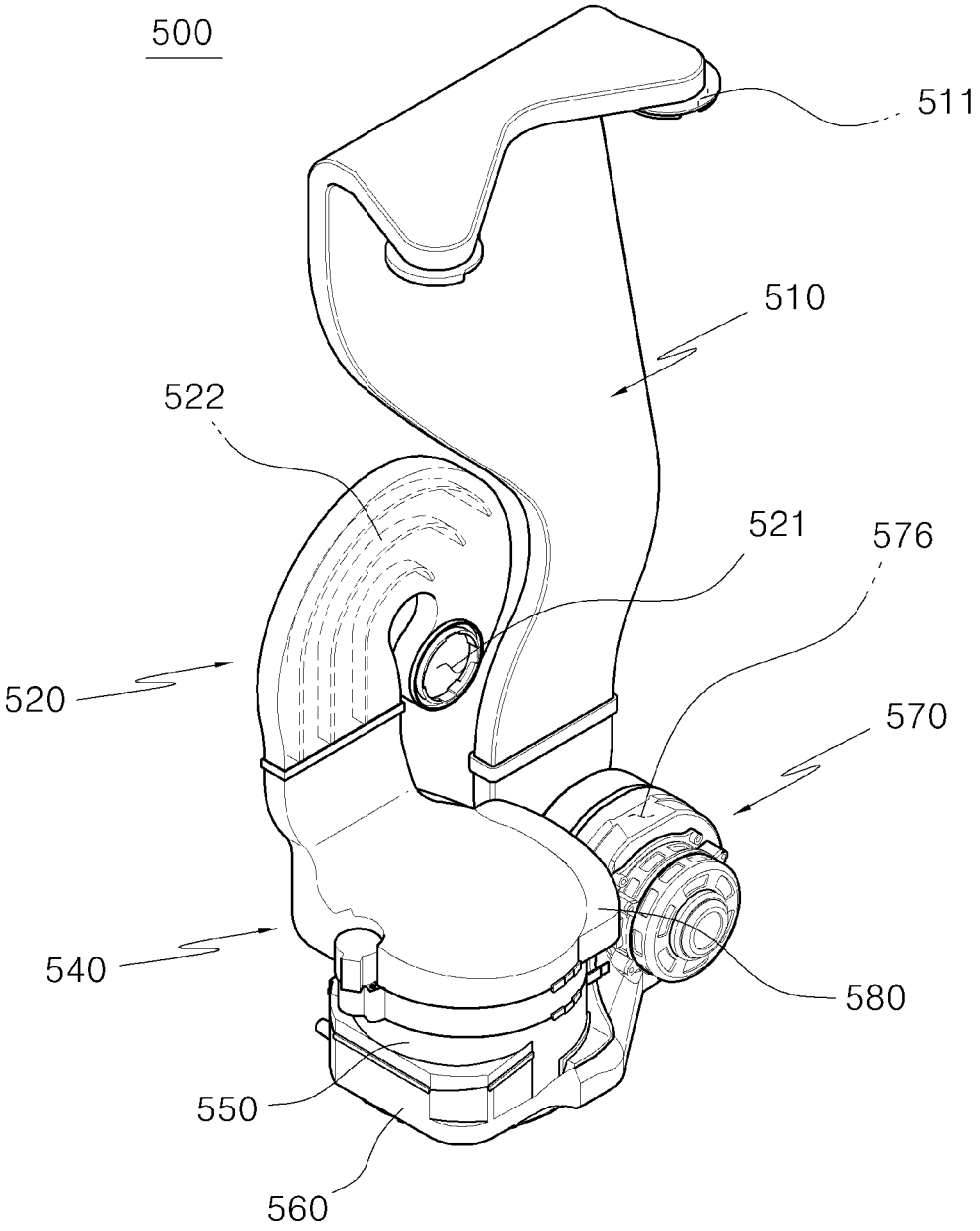
FIG. 4 is a view illustrating the drying assembly in accordance with one embodiment of the present disclosure.
Figure 5:
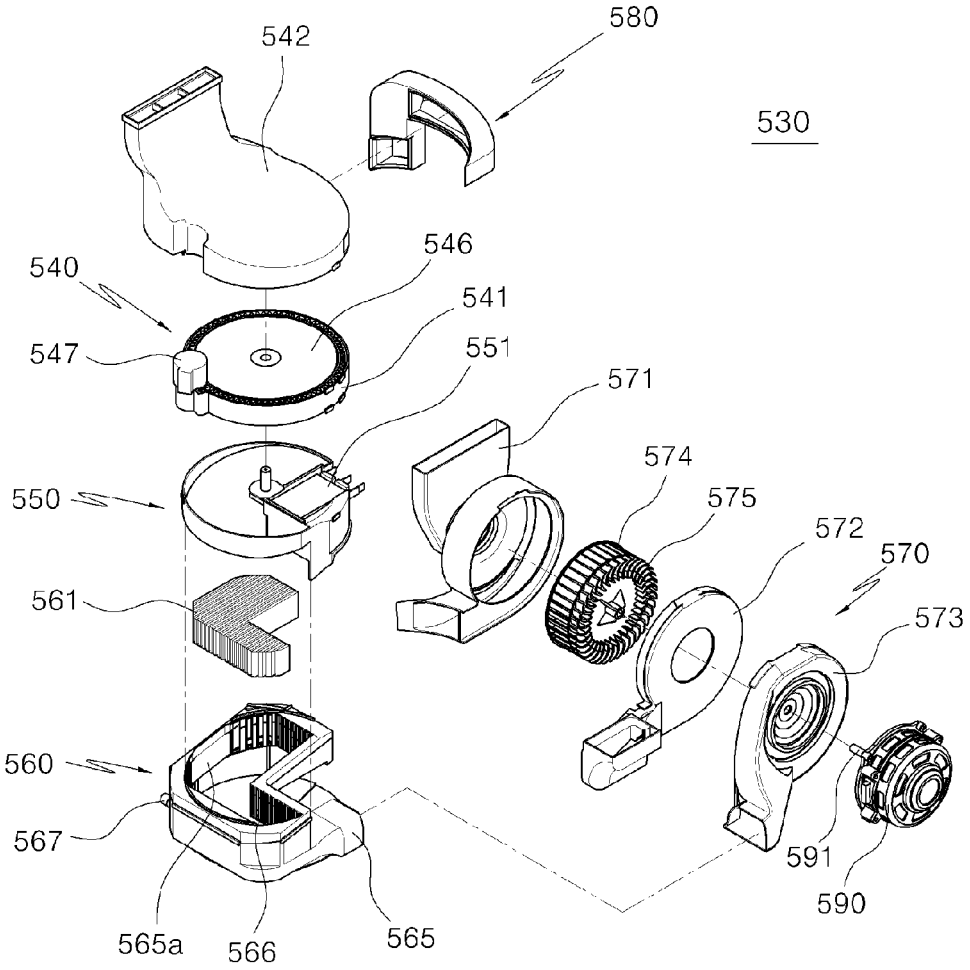
FIG. 5 is an exploded perspective view illustrating the drying assembly in accordance with one embodiment of the present disclosure.
Figure 6:
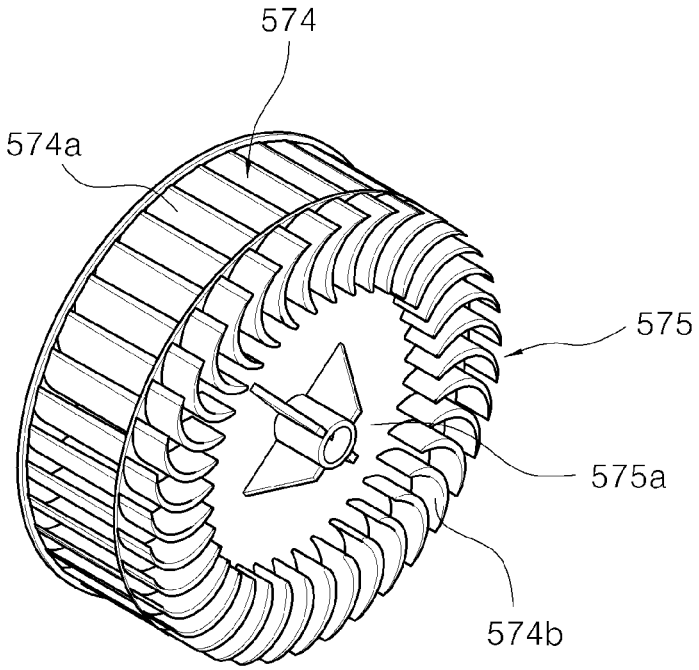
FIG. 6 is a perspective view illustrating a fan of the dishwasher in accordance with one embodiment of the present disclosure.
Figure 7A:
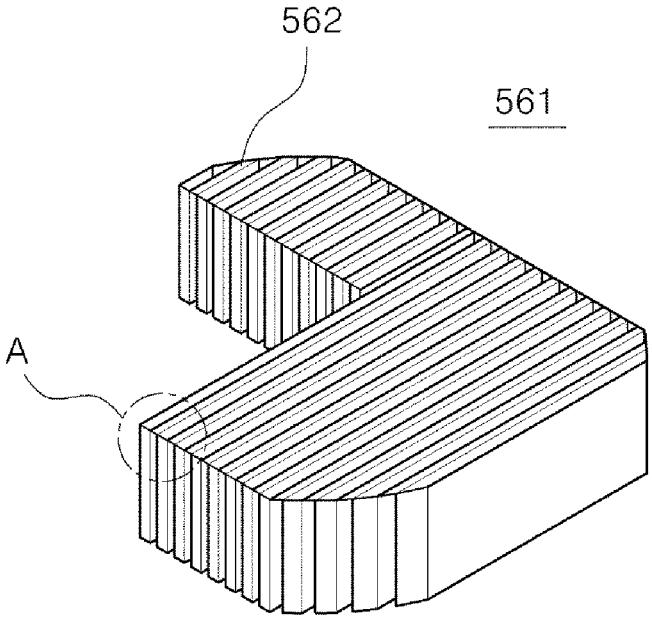
FIG. 7*a* is a perspective view illustrating a condenser of the dishwasher in accordance with one embodiment of the present disclosure.
Figure 7B:
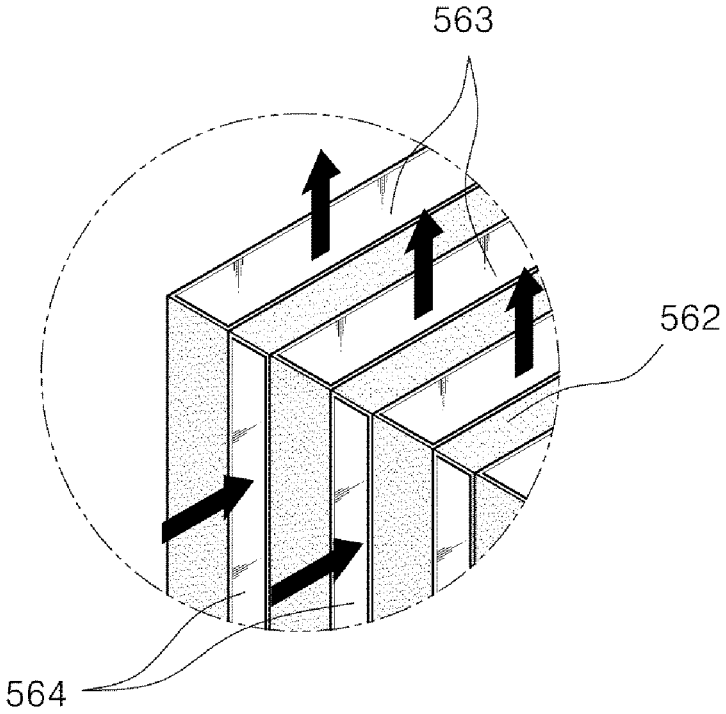
FIG. 7*b* is an enlarged view illustrating a part of FIG. 7*a;*
Figure 8A:
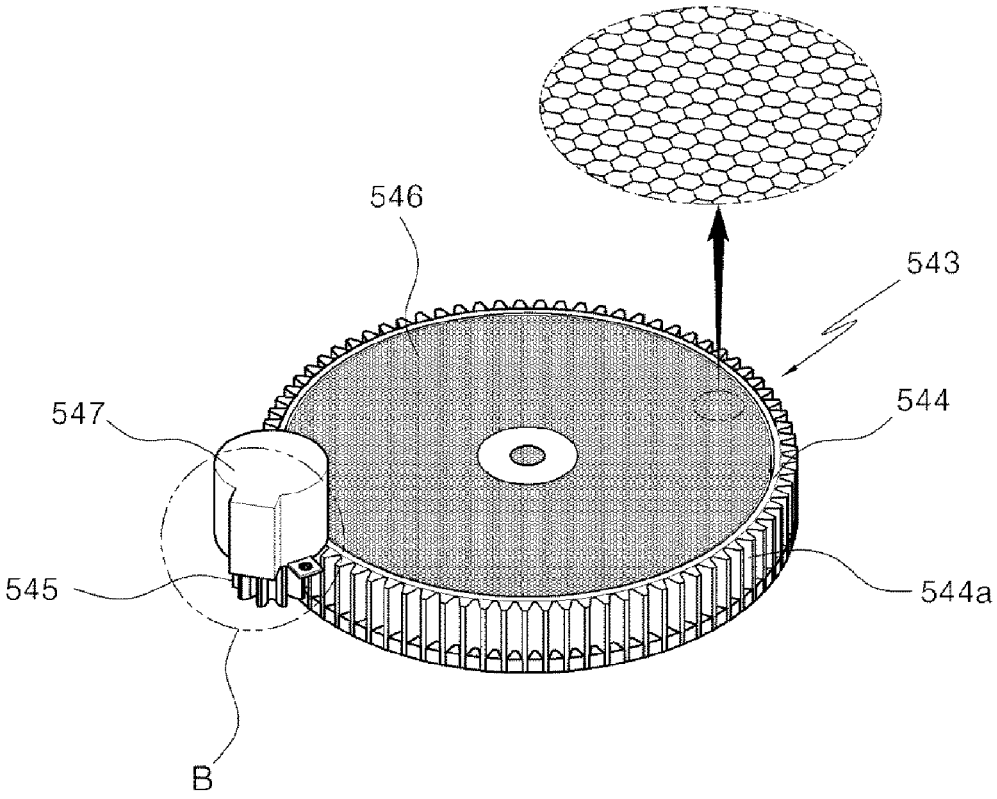
FIG. 8*a* is an enlarged perspective view illustrating a configuration of components arranged inside a drying duct of the dishwasher in accordance with one embodiment of the present disclosure.
Figure 8B:
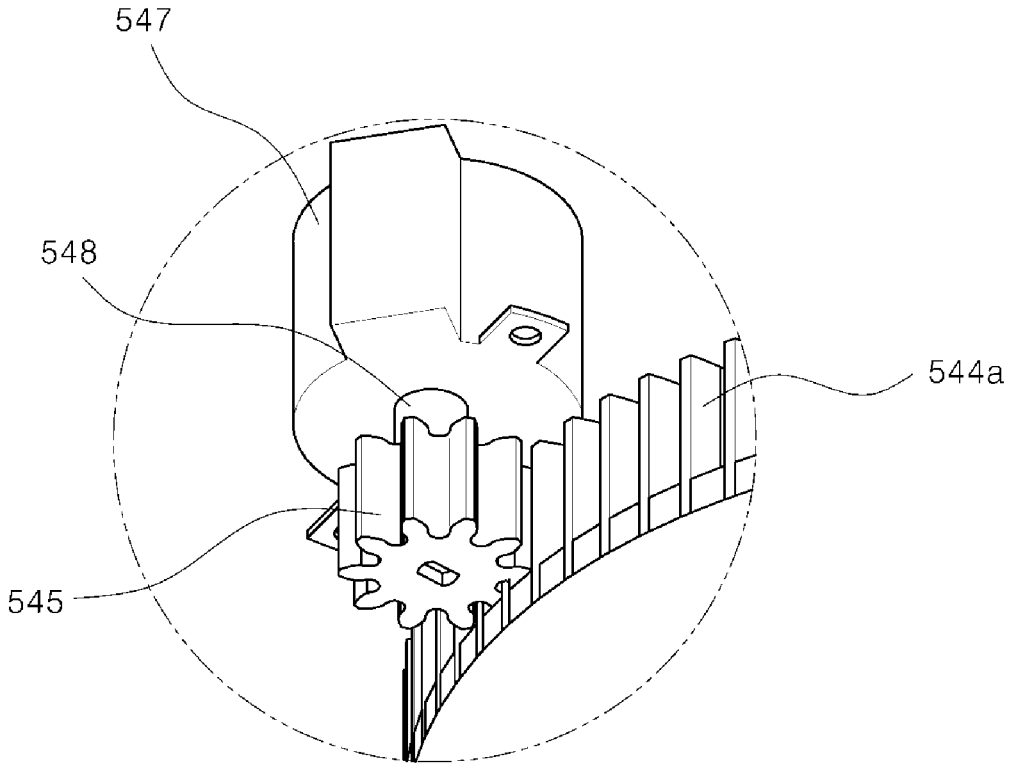
FIG. 8*b* is an enlarged view illustrating a part of FIG. 8*a;*

FIG. 3 is a view illustrating a state in which a drying assembly is coupled to a washing tub of the dishwasher in accordance with one embodiment of the present disclosure, FIG. 4 is a view illustrating the drying assembly in accordance with one embodiment of the present disclosure, FIG. 5 is an exploded perspective view illustrating the drying assembly in accordance with one embodiment of the present disclosure, FIG. 6 is a perspective view illustrating a fan of the dishwasher in accordance with one embodiment of the present disclosure, FIG. 7*a* is a perspective view illustrating a condenser of the dishwasher in accordance with one embodiment of the present disclosure, FIG. 7*b* is an enlarged view illustrating a part of FIG. 7*a*, FIG. 8*a* is an enlarged perspective view illustrating a configuration of components arranged inside a drying duct of the dishwasher in accordance with one embodiment of the present disclosure, and FIG. 8*b* is an enlarged view illustrating a part of FIG. 8*a*. Hereinafter, a desiccant wheel and a dehumidifying member 546 may be used as the same meaning. Reference numerals not shown are referred to in FIGS. 1 and 2.

As illustrated in FIGS. 3 to 8*b*, the dishwasher 1 may further include a drying assembly 500 to remove wash water remaining on dishware and in the washing tub 30. Particularly, the dishwasher 1 may further include at least one drying assembly 500.

The drying assembly 500 may be disposed inside the body 10 to be installed on the outside of the washing tub 30. The drying assembly 500 may also be disposed outside the body 10 to communicate with the washing tub 30.

Particularly, the dishwasher 1 may include a plurality of drying assemblies 500. The plurality of drying assemblies 500 may include a first drying assembly and a second drying assembly, which are disposed at both sides of the washing tub 30, respectively. The first drying assembly may be disposed at a left side 38 of the washing tub 30, and the second drying assembly may be disposed at a right side (not shown) of the washing tub 30.

The first drying assembly and the second drying assembly may have a symmetric structure.

Hereinafter, for convenience of description, the first drying assembly disposed at the left side 38 of the washing tub 30 will be mainly described. FIG. 3 is a view in which the second assembly is omitted.

The drying assembly 500 may include, for example, a drying unit 530, an intake duct 510, and a discharge duct 520.

The drying assembly 500 may include an insulating member (not shown).

The insulating member (not shown) may have a thickness of more than 5 mm and less than 30 mm.

The drying unit 530 may be disposed on a lower portion of the washing tub 30. A dehumidifying member 546 configured to absorb moisture contained in air may be accommodated inside the drying unit 530.

Air including water vapor in the washing tub 30 is suctioned into the drying unit 530, and is discharged to the inside of the washing tub 30 after water vapor is removed by the dehumidifying member 546 disposed inside the drying unit 530. The drying assembly 500 may include the intake duct 510 to obtain moist air in the washing tub 30 and transfer the moist air to the drying unit 530 and the discharge duct 520 to discharge dried air from the drying unit 530 toward the inside of the washing tub 30.

The intake duct 510 may be disposed on the left side 38 of the washing tub 30 so that air in the washing tub 30 is transferred to the drying unit 530. At least one inlet 511 may be formed on the intake duct 510. Particularly, the at least one inlet 511 may be coupled to at least one opening 30*a* formed on an upper surface 36 of the washing tub 30. Air in the washing tub 30 may be introduced to the inside of the intake duct 510 through the at least one inlet 511.

The intake duct 510 may be disposed on at least one side between the left side 38 of the washing tub 30 and a right side (not shown) of the washing tub 30 so that air in the washing tub 30 is transferred to the drying unit 530.

The discharge duct 520 may be disposed on the left side 38 of the washing tub 30 so that air passed through the drying unit 530 is transferred to the inside of the washing tub 30 again. The discharge duct 520 may be disposed on the front of the intake duct 510. At least one outlet 521 may be formed on the discharge duct 520. Particularly, the at least one outlet 521 may be coupled to at least one opening hole 30*b* formed on the left side 38 of the washing tub 30. Air in the discharge duct 520 may be discharged toward the inside of the washing tub 30 through the at least one outlet 521.

In the discharge duct 520, a plurality of guide flow paths 522 may be provided. Air passed through the drying unit 530 may be guided along the plurality of guide flow paths 522 and discharged to the inside of the washing tub 30 through the at least one outlet 521.

The discharge duct 520 may be disposed on at least one side between the left side 38 of the washing tub 30 and the right side (not shown) of the washing tub 30 to be arranged on the front of the intake duct 510.

The drying unit 530 may be disposed between the intake duct 510 and the discharge duct 520 to be connected to the intake duct 510 and the discharge duct 520.

The drying unit 530 may include, for example, a drying duct 540, a heating duct 550, a condensing duct 560, and a blowing duct 570.

The drying duct 540 may be connected to the discharge duct 520 to face a bottom surface 37 of the washing tub 30.

The drying duct 540 may include, for example, a casing 541 and a discharge channel 542. The dehumidifying member 546 and a rotation transmitting device 543 of the dehumidifying member 546 may be accommodated in the casing 541. The dehumidifying member 546 may be rotatably accommodated in the casing 541. The dehumidifying member 546 may include polymer materials. In comparison with porous materials such as zeolite and silica gel, the polymer materials have high absorption rate per unit weight. Therefore, space for installing the dehumidifying member 546 may be reduced so that space utilization may be improved. In addition, as for the dehumidifying member 546 having polymer materials, thermal energy required to regenerate the dehumidifying member 546 is smaller than that of the dehumidifying member having porous material so that the energy efficiency of the dishwasher 1 may be improved. The dehumidifying member 546 may be manufactured by stacking dehumidifying sheets (not shown). Since flow resistance to air passing through the dehumidifying member 546 may be smaller than that of the dehumidifying member having porous material, the efficiency of the dehumidification may be improved by elongating the dehumidifying member 546 in the flow direction of the air. The dehumidifying member 546 may have a porous honeycomb structure (Honeycomb) to secure a spacious dehumidifying area.

The dehumidifying member 546 may have a circular shape. A diameter of the dehumidifying member 546 may be greater than or equal to 50 mm and may be less than or equal to 400 mm. A required time per one rotation of the dehumidifying member 546 may be four minutes or less. The dehumidifying member 546 may include a dehumidifying area 546*a* and a regenerating area 546*b* separated from the dehumidifying area 546*a* so that the dehumidifying member 546 may perform dehumidifying and regenerating at the same time. Particularly, the dehumidifying area 546*a* of the dehumidifying member 546 may dehumidify air transferred to the drying unit 530 through the at least one inlet 511 and transfer dry air to the inside of the washing tub 30. The dehumidifying member 546 having moisture may be regenerated in the regenerating area 546*b* by a heater 551. For example, the dehumidifying member 546 may be regenerated in the regenerating area 546*b* by a heater 551 when the dehumidifying member 546 has become saturated with water. The dehumidifying member 546 is rotatable so that the dehumidification and the regeneration of the dehumidifying member 546 may be performed by turns. That is, in an embodiment the dehumidification and the regeneration of the dehumidifying member 546 may be performed substantially simultaneously or substantially concurrently.

An area of the regenerating area 546*b* may be 50% or less of a total area of the dehumidifying member 546. As mentioned above, the dehumidifying member may be rotatable.

The dehumidifying member 546 may receive driving force from a rotation driving device 547 through the rotation transmitting device 543 for the rotation.

The rotation transmitting device 543 and the dehumidifying member 546 may be accommodated inside the casing 542. The rotation transmitting device 543 may include a dehumidifying member frame 544 and a rotation gear 545.

The dehumidifying member frame 544 may be disposed along a circumference of the dehumidifying member 546 on the outside of the dehumidifying member 546. The dehumidifying member 546 may be integrally rotatable with the dehumidifying member frame 544. The dehumidifying member frame 544 may have a shape and a size corresponding to the dehumidifying member 546. On the outside surface of the dehumidifying member frame 544, one or more teeth 544*a* may be formed.

The rotation gear 545 may be connected to the rotation driving device 547 supplying driving force for the rotation of the dehumidifying member 546. The rotation driving device 547 may be disposed on one side of the discharge channel 542 disposed on an upper portion of the casing 541. The rotation gear 545 may be connected to the rotation driving device 547 by coupling to a rotation driving shaft 548. The rotation gear 545 may be connected to the dehumidifying member frame 544 to transmit torque to the dehumidifying member 546, and may have a shape corresponding to the tooth 544*a* of the dehumidifying member frame 544. The rotation gear 545 may transmit driving force supplied by the rotation driving device 547 to the dehumidifying member frame 544, and the dehumidifying member 546 may receive driving force from the dehumidifying member frame 544 so that the dehumidifying member 546 may be integrally rotated together with the dehumidifying member frame 544.

The discharge channel 542 may be disposed between the discharge duct 520 and the casing 541 to connect the discharge duct 520 to the casing 541. A partition 542*a* may be formed in the discharge channel 542 so that the dehumidifying member 546 may be divided into the dehumidifying area 546*a* and the regenerating area 546*b*. The partition 542*a* may be extended from an inner wall of the discharge channel 542 toward the dehumidifying member 546 to make contact with the dehumidifying member 546. The partition 542*a* may be integrally formed with the discharge channel 542. Alternatively, the partition 542*a* may be formed separate from the discharge channel 542 and may be accommodated in the discharge channel 542.

The heating duct 550 may be disposed between the drying duct 540 and the condensing duct 560. A heater installing unit (not shown) in which a heater 551 is installed may be provided in the heating duct 550. The heater 551 may be adjacent to the regenerating area 546*b* to regenerate the regenerating area 546*b* by applying heat to the regenerating area 546*b*. The heater 551 may be disposed on a lower portion of the regenerating area 546*b* to be adjacent to the regenerating area 546*b*. The heater 551 may have a shape and a size corresponding to the regenerating area 546*b*.

The heater 551 may include a Positive Temperature Coefficient heater (PTC). The PTC heater maintains a constant temperature according to the air flow, so the FTC heater has excellent reliability. That is, when using a wire heater, there will be a risk of fire since a temperature of the wire heater is rapidly increased when the rotation of the dehumidifying member 546 is stopped. But the PTC heater is safe because the FTC heater has an isothermal feature.

The heating duct 550 may include heat-durable plastic. However, the heating duct 550 adjacent to the heater 551 may include stainless steel. That is, according to one embodiment of the present disclosure, the heater installing unit (not shown) may be formed of stainless steel.

The condensing duct 560 may be disposed on a lower portion of the heating duct 550. The condensing duct 560 may connect the blowing duct 570 to the heating duct 560. A condenser 561 may be accommodated in the condensing duct 560. The condenser 561 may include a plurality of tubes 562. In the condensing duct 560, the plurality of tubes 562 may be arranged in parallel to each other. The plurality of tubes 562 may be formed of plastic.

The plurality of tubes 562 of the condenser 561 may form a first flow path 563 and a second flow path 564. Particularly, the first flow path 563 may be disposed between the plurality of tubes 562 so that air discharged from the blowing duct 570 passes through the condenser 561 in a first direction (A) toward an upper side of the washing tub 30, and is transferred to the dehumidifying area 546*a*. The second flow path 564 may be disposed in the plurality of tubes 562 so that air supplied to a connecting channel 580 by passing through the regenerating area 546*b* passes through the condenser 561 in a second direction (B) perpendicular to the first direction (A), and is transferred to the blowing duct 570.

That is, the plurality of tubes 562 forming the first flow path 563 may have a plurality of surfaces opened toward the first direction (A) to face to each other. The plurality of tubes 562 forming the second flow path 564 may have a plurality of surfaces opened toward the second direction (B) to face to each other.

The first flow path 563 and the second flow path 564 may be separated from each other. Air flowing in the first flow path 563 and air flowing in the second flow path 564 may not be mixed.

A drain pipe 567 may be formed on one side of the condensing duct 560. The drain pipe 567 may be integrally formed with the condensing duct 560. Condensate water generated by exchanging heat between air flowing in the first flow path 563 and air flowing in the second flow path 564 may be discharged to the outside of the condensing duct 560 through the drain pipe 567.

The condenser 561 may be tilted so that condensate water may be easily discharged. Particularly, the condenser 561 may be declined toward the drain pipe 567. A gradient of the condenser 561 may range from 30° or more and 90° or less. When a gradient of the condenser 561 is less than 30°, condensate water may not be easily discharged and air circulation through the second flow path 564 may not be smooth so drying efficiency may be reduced.

The condensing duct 560 may include a return channel 565. The return channel 565 may be formed along an edge of the condensing duct 560. The return channel 565 may include an inner surface 565*a* facing the condenser 561, and a plurality of slits 566 may be formed on the inner surface 565*a*. The return channel 565 may connect the connecting channel 580 to a second channel 573 of the blowing duct 570.

The blowing duct 570 may be connected to the intake duct 510. The blowing duct 570 may include, for example, an inlet channel 571, a first channel 572, and a second channel 573. Fans 574 and 575 may be accommodated in the blowing duct 570. The fans 574 and 575 may include a double suction fan. The fans 574 and 575 may include a centrifugal fan. The inlet channel 571, the first channel 572, and the second channel 573 may be coupled to each other and form an accommodation space 576 in which the fans 574 and 575 are accommodated. The fans 574 and 575 may include a dehumidifying fan 574 and a regenerating fan 575. Particularly, the dehumidifying fan 574 may be accommodated inside the inlet channel 571 connected to the intake duct 510 and the regenerating fan 575 may be accommodated inside the first channel 572 coupled to the inlet channel 571 toward an inner side direction of the washing tub 30.

The dehumidifying fan 574 may include a plurality of rotating blades 574*a* and a plate 574*b* in which the plurality of rotating blades 574*a* are arranged.

The regenerating fan 575 may include a plurality of blades 575*a*. The plurality of blades 575*a* of the regenerating fan 575 may be disposed on the plate 574*b* of the dehumidifying fan 574. Particularly, the plurality of rotating blades 574*a* of the dehumidifying fan 574 and the plurality of blades 575*a* of the regenerating fan 575 may face to each other with respect to the plate 574*b*. When the plurality of rotating blades 574*a* of the dehumidifying fan 574 is disposed on one side of the plate 574*b*, the plurality of blades 575*a* of the regenerating fan 575 may be disposed on the other side of the plate 574*b*.

The plurality of rotating blades 574*a* of the dehumidifying fan 574 and the plurality of blades 575*a* of the regenerating fan 575 may be fixed to the plate 574*b*. Therefore, the plurality of rotating blades 574*a* of the dehumidifying fan 574, the plate 574*b* and the plurality of blades 575*a* of the regenerating fan 575 may be integrally rotated.

A thickness of the dehumidifying fan 574 may be greater than that of the regenerating fan 575. Particularly, the plurality of rotating blades 574*a* of the dehumidifying fan 574 may have a greater width than that of the plurality of blades 575*a* of the regenerating fan 575 in a direction of a driving shaft 591.

The second channel 573 may be coupled to the first channel 572 toward an inner direction of the washing tub 30. A driving device 590 configured to supply driving force to rotate the fans 574 and 575 may be installed on the outside of the second channel 573. The dehumidifying fan 574 and the regenerating fan 575 may be integrally rotated by being connected to the driving device 590. That is, the dehumidifying fan 574 and the regenerating fan 575 may be integrally rotated with respect to the driving shaft 591 connected to the driving device 590.

The inlet channel 571, the first channel 572 and the second channel 573 may have separated inner space so that air passing through each channel is prevented from being mixed.

The inlet channel 571 may connect the intake duct 510 to the condensing duct 560.

The first channel 572 may be connected to the heating duct 550 so that air passed through the first channel 572 may be transferred to the heater 551.

The second channel 573 may be connected to the condensing duct 560. Particularly, the second channel 573 may be connected to the return channel 565.

The drying unit 530 may further include the connecting channel 580. The connecting channel 580 may connect the drying duct 540 to the condensing duct 560. Particularly, one end portion of the connecting channel 580 may be coupled to the outside of the discharge channel 542 to be communicated with the regenerating area 546*b*, and the other end portion of connecting channel 580 may be coupled to the condensing duct 560 to avow air discharged from the connecting channel 580 to pass through the condenser 561 in the second direction (B).

The dishwasher 1 may maintain a temperature of air discharged to the washing tub 30 through the at least one outlet 521 to be below 100° C., which is suitable drying heat for sensitive tableware, such as plastic tableware and glassware.

Since the temperature of air discharged to the washing tub 30 is below 100° C., the intake duct 510, the discharge duct 520, the drying duct 540, the heating duct 550, the condensing duct 560, and the blowing duct 570 may include heat-durable plastic. However, among the intake duct 510, the discharge duct 520, the drying duct 540, the heating duct 550, the condensing duct 560, and the blowing duct 570, a portion adjacent to the heater 551 may include stainless steel for additional heat-resistance. The portion having stainless steel is not limited the heating duct 550.

The drying assembly 500 of the washing tub 30 may form a dehumidifying flow path 700 and a regenerating flow path 800 and the description thereof will be described later.

Figure 9:
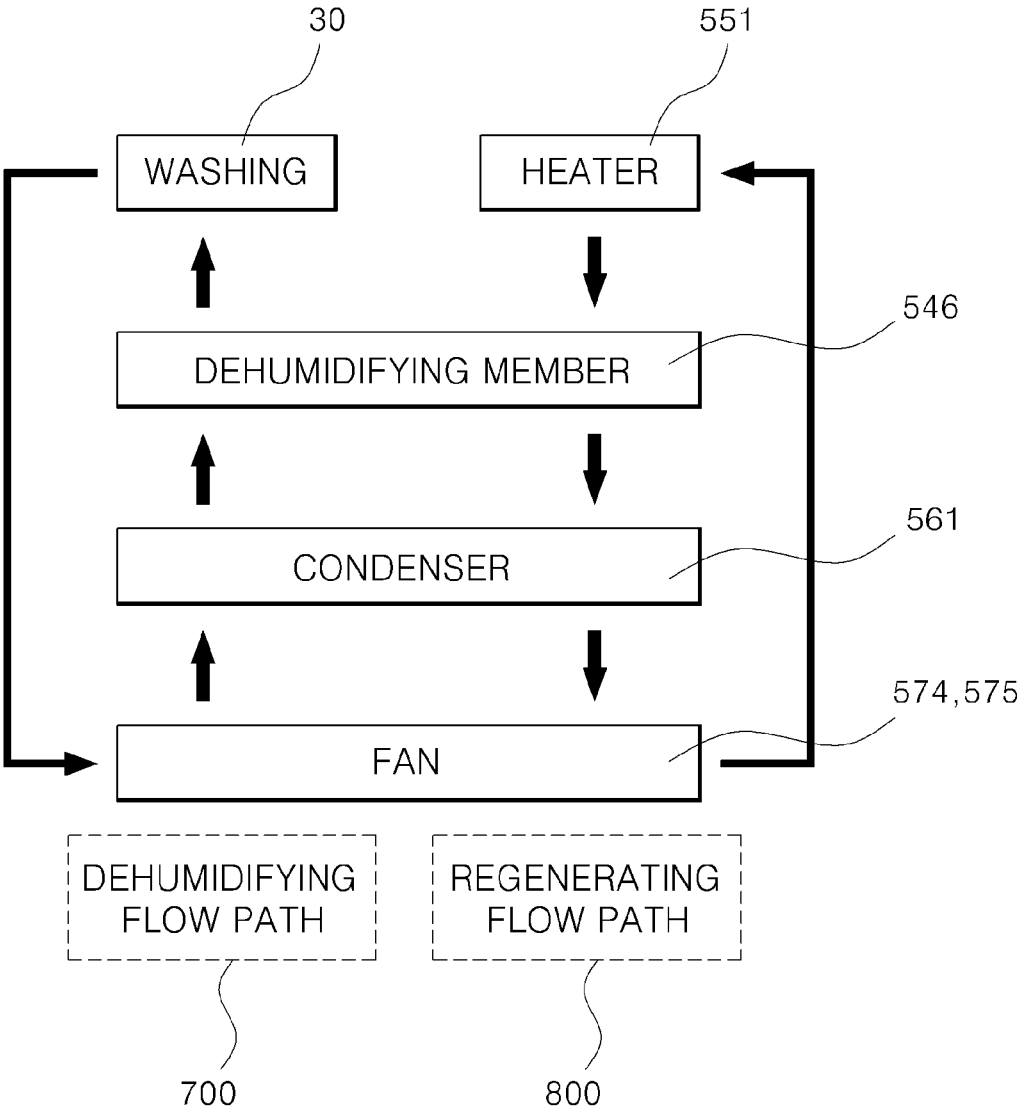
FIG. 9 is a flow chart illustrating a dehumidification and a regeneration of the dishwasher in accordance with one embodiment of the present disclosure.
Figure 10:
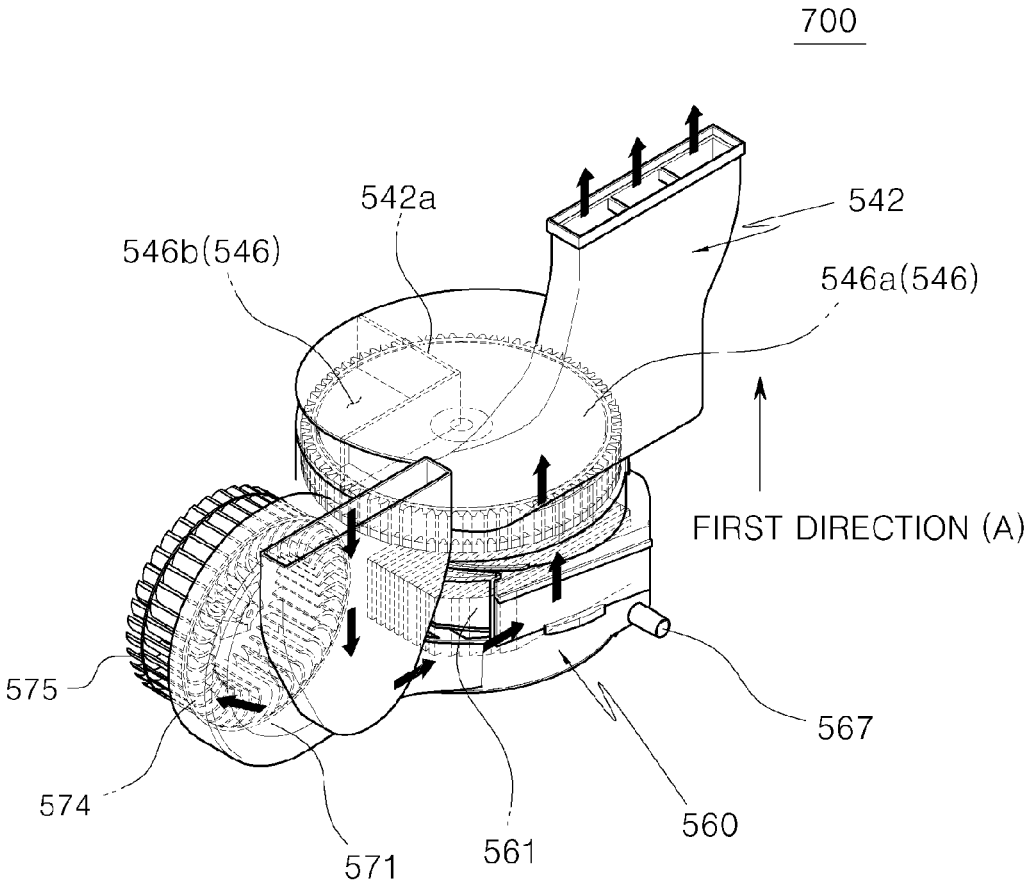
FIG. 10 is a view illustrating a dehumidifying flow path of the dishwasher in accordance with one embodiment of the present disclosure.
Figure 11:
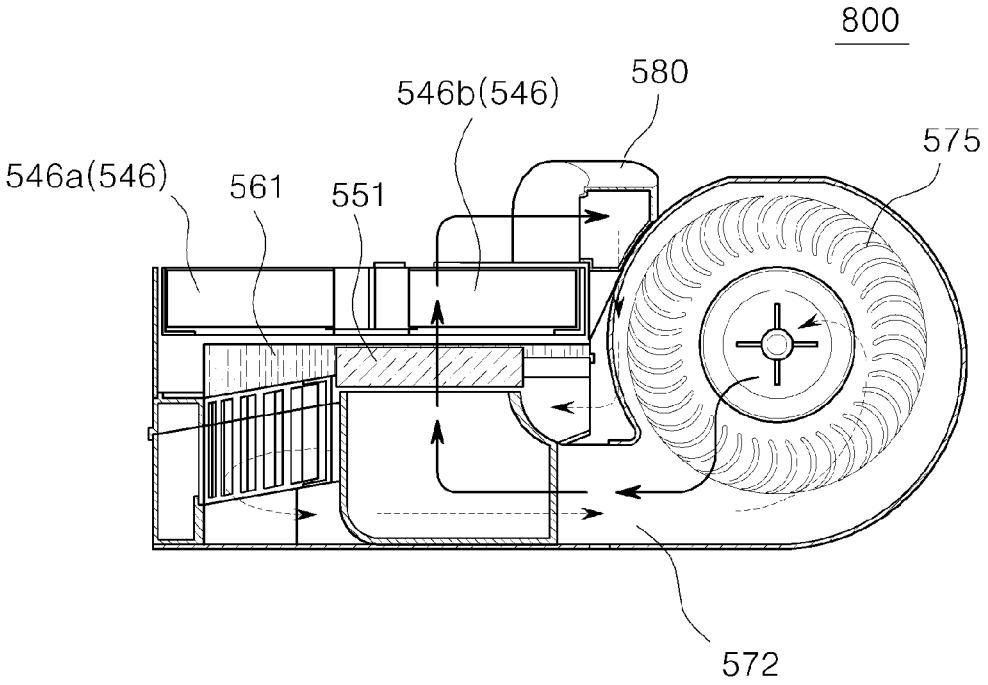
FIG. 11 is a view illustrating a regenerating flow path of the dishwasher in accordance with one embodiment of the present disclosure.
Figure 12:
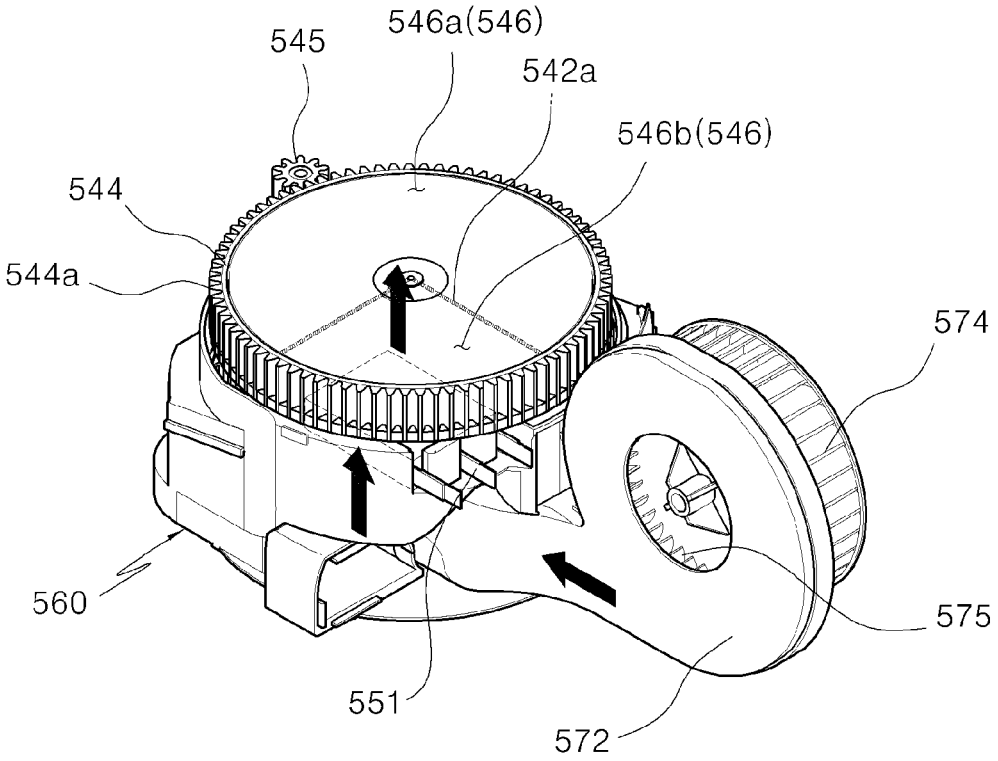
FIG. 12 is an enlarged view illustrating one portion of the regenerating flow path of FIG. 11.
Figure 13:
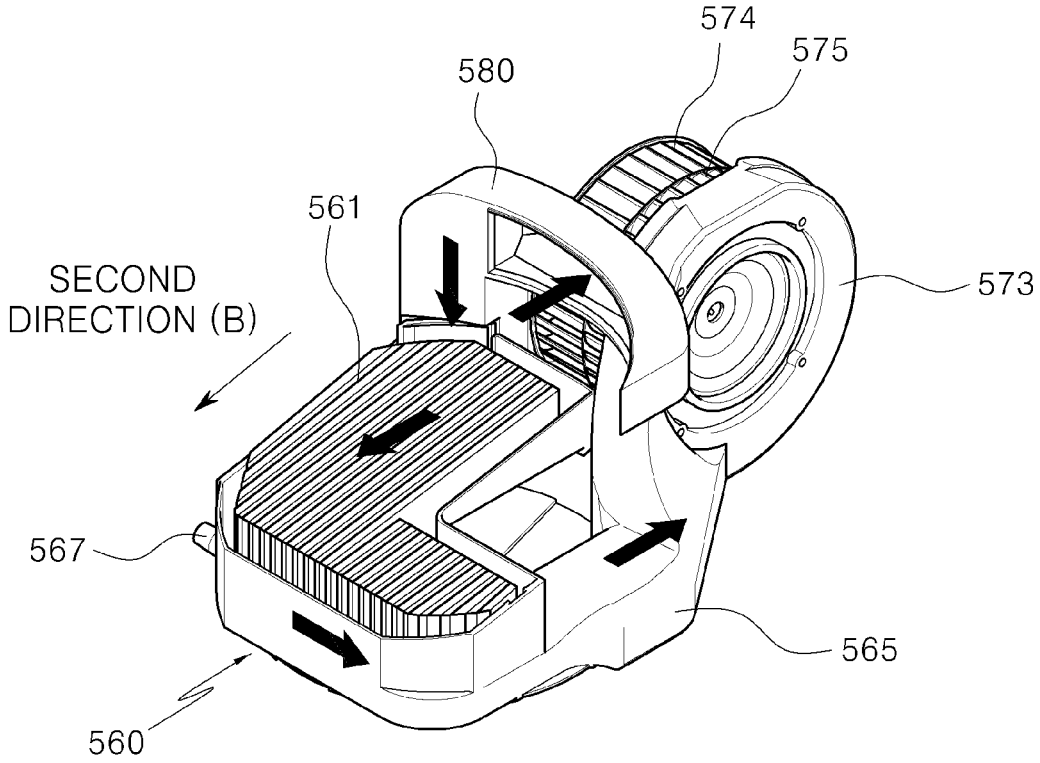
FIG. 13 is an enlarged view illustrating another portion of the regenerating flow path of FIG. 11.

FIG. 9 is a flow chart illustrating a dehumidification and a regeneration of the dishwasher in accordance with one embodiment of the present disclosure, FIG. 10 is a view illustrating a dehumidifying flow path of the dishwasher in accordance with one embodiment of the present disclosure, FIG. 11 is a view illustrating a regenerating flow path of the dishwasher in accordance with one embodiment of the present disclosure, FIG. 12 is an enlarged view illustrating one portion of the regenerating flow path of FIG. 11, and FIG. 13 is an enlarged view illustrating another portion of the regenerating flow path of FIG. 11. Hereinafter, reference numerals not shown are referred to in FIGS. 1 and 8*b*.

The dishwasher 1 may include a dehumidifying flow path 700 in which air inside the washing tub 30 is circulated and a regenerating flow path 800 in which air configured to regenerate the dehumidifying member 546 is circulated.

The dehumidifying flow path 700 and the regenerating flow path 800 may be separated to prevent the air circulating in the dehumidifying flow path 700 and the regenerating flow path 800 from being mixed.

The dehumidifying flow path 700 and the regenerating flow path 800 may form a closed flow path, respectively.

The washing tub 30, the intake duct 510, the dehumidifying fan 574, the first flow path 563 of the condenser 561, the dehumidifying area 546*a*, and the discharge duct 520 may be disposed on the dehumidifying flow path 700.

Air inside the washing tub 30, which is passed through the at least one inlet 511 passes the intake duct 510 and is transferred to the dehumidifying fan 574 accommodated inside the inlet channel 571. Air transferred to the dehumidifying fan 574 is transferred to the condensing duct 560, by moving along the inlet channel 571 and reaches the dehumidifying area 546*a* after passing through the condenser 561 by moving along the first flow path 563. When air inside the washing tub 30 passes through the dehumidifying area 546*a*, a sorption phenomena occurs by a pressure difference between surface pressure of the dehumidifying area 546*a* and vapor pressure contained in air inside the washing tub 30, and moisture contained in air inside the washing tub 30 is transferred to the dehumidifying area 546*a* so that aft inside the washing tub 30 is dried. Dry aft passed through the dehumidifying area 546*a* passes through the discharge duct 520 and is transferred to the inside of the washing tub 30 again.

The first channel 572, the regenerating fan 575, the heating duct 550, the regenerating area 546*b*, the connecting channel 580, the second flow path 564 of the condenser 561, the return channel 565, and the second channel 573 may be disposed on the regenerating flow path 800.

Air passed through the regenerating fan 575 accommodated inside the first channel 572 is transferred to the heater 551 accommodated in the heating duct 550 by passing through the first channel 572. Air passed through the heater 551 reachs the regenerating area 546*b*. Air reaching the regenerating area 546*b* absorbs moisture contained in the regenerating area 546*b*, passes the connecting channel 580 and passes through the condenser 561 by moving along the second flow path 564. Air passed through the condenser 561 is transferred to the second channel 573 through the return channel 565, and is transferred to the regenerating fan 575 again.

The dehumidifying flow path 700 and the regenerating flow path 800 may be crossed to exchange heat between air circulating in the dehumidifying flow path 700 and air circulating in the regenerating flow path 800. During the exchange of heat between air circulating in the dehumidifying flow path 700 and air circulating in the regenerating flow path 800, condensate water may be generated, and condensate water may be discharged to the outside of the condensing duct 560 through the drain pipe 567 formed on the condensing duct 560.

The dishwasher 1 may have a single drying function. The single drying function is configured to dry wet dishware quickly. Since dehumidifying and regenerating may be performed at the same time by the rotation of the dehumidifying member 546, the drying of dishware may be achieved without heating wash water. Therefore, a drying time and energy for drying dishware may be reduced.

Figure 14:
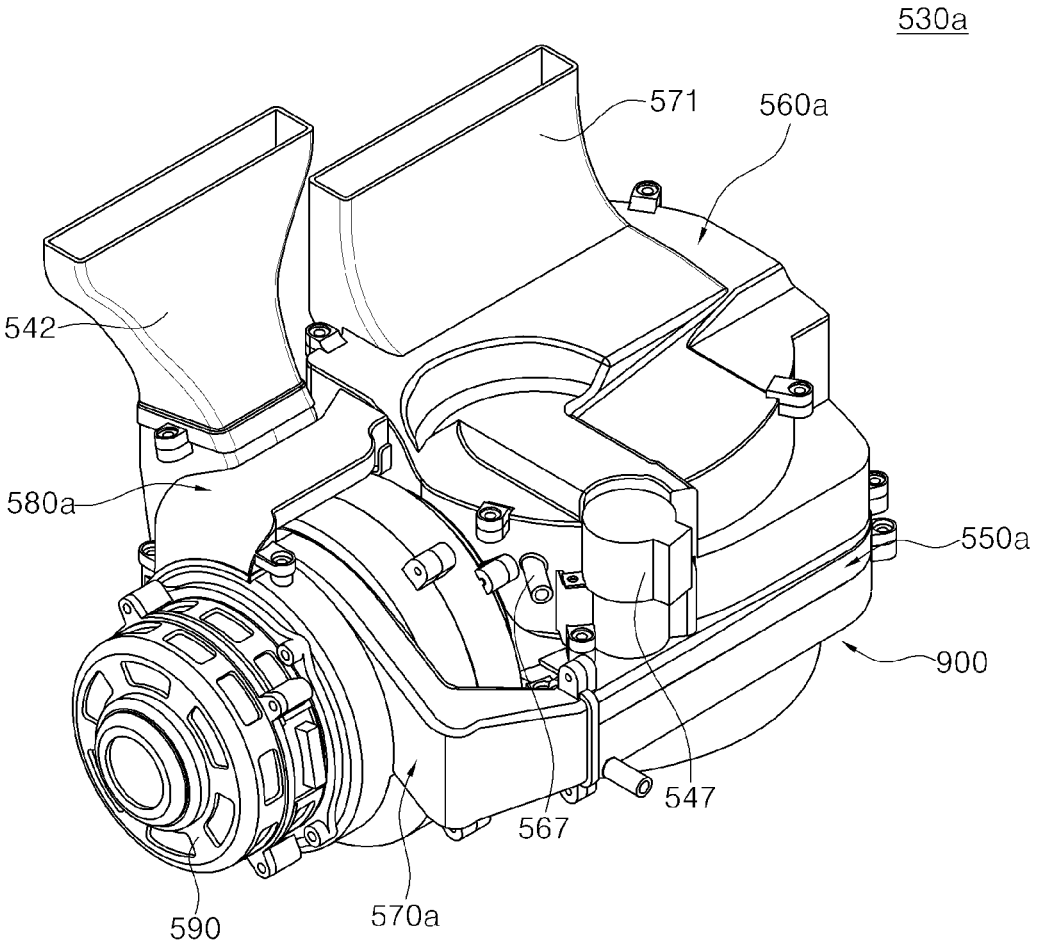
FIG. 14 is a perspective view illustrating a drying assembly of a dishwasher in accordance with another embodiment of the present disclosure.
Figure 15:
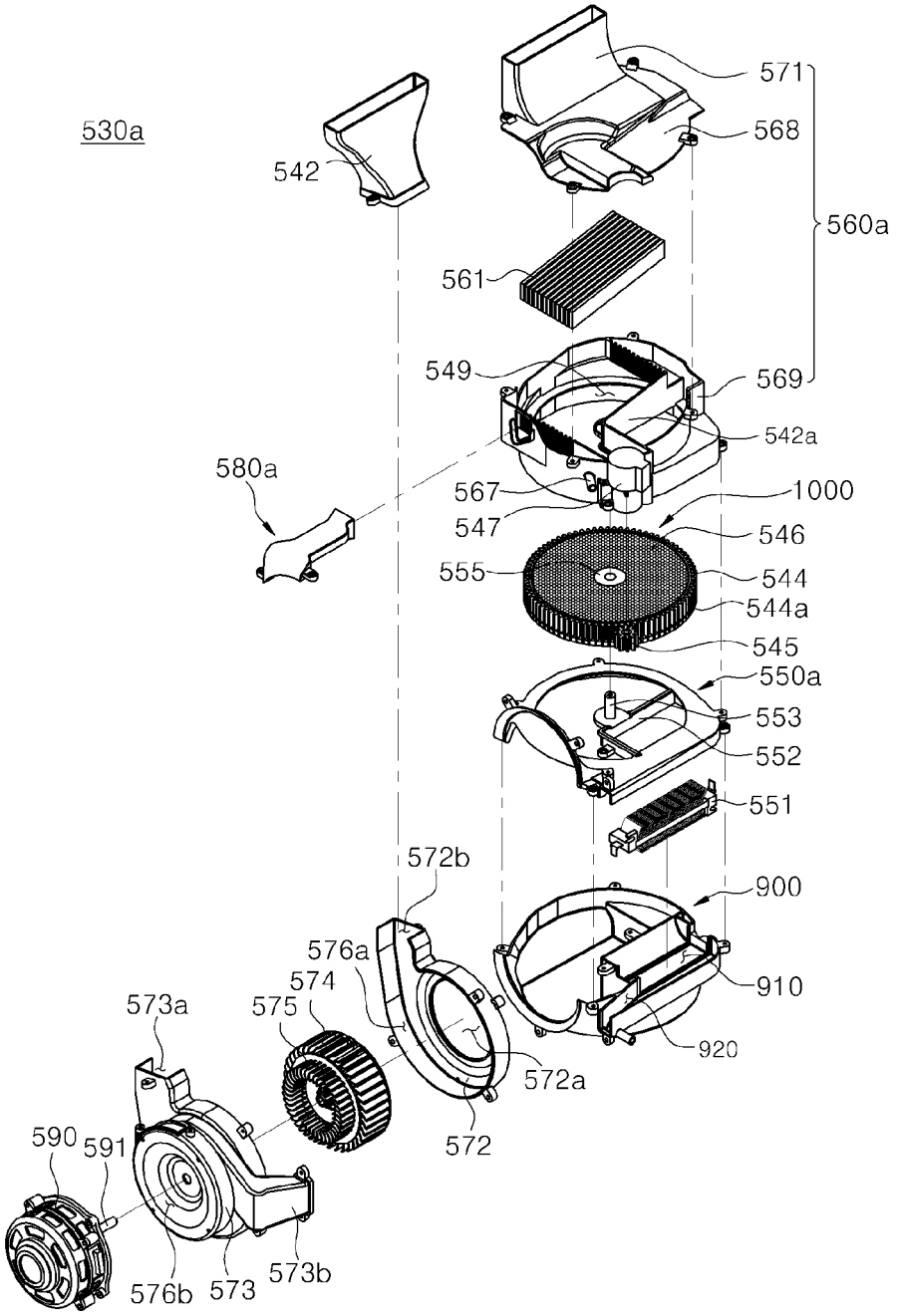
FIG. 15 is an exploded perspective view illustrating the drying assembly of a dishwasher in accordance with another embodiment of the present disclosure.

FIG. 14 is a perspective view illustrating a drying assembly of a dishwasher in accordance with another embodiment of the present disclosure, and FIG. 15 is an exploded perspective view illustrating the drying assembly of a dishwasher in accordance with another embodiment of the present disclosure. Hereinafter, a description of parts already shown in FIGS. 1 to 13 will be omitted. Reference numerals not shown are referred to in FIGS. 1 and 13. A desiccant wheel and a dehumidifying member 546 may be used herein as having a same or similar meaning.

As illustrated in FIGS. 14 and 15, a dishwasher 1 may further include a drying assembly 500 to remove wash water remaining in or on dishware and inside of a washing tub 30.

The drying assembly 500 may be disposed inside a body 10 to be installed on the outside of the washing tub 30. The drying assembly 500 may alternatively be disposed outside the body 10 to communicate with the washing tub 30.

The drying assembly 500 may include, for example, a drying unit 530*a*, an intake duct 510, and a discharge duct 520.

The drying unit 530*a* may be disposed on a lower portion of the washing tub 30. A dehumidifying member 546 configured to absorb moisture contained in air may be accommodated inside the drying unit 530*a*.

Air including water vapor inside the washing tub 30 is suctioned into the drying unit 530, and is discharged to the inside of the washing tub 30 after water vapor is removed by the dehumidifying member 546 disposed inside the drying unit 530*a*. The drying assembly 500 may include the intake duct 510 and the discharge duct 520 to discharge air suctioned in the washing tub 30 toward the inside of the washing tub 30.

The drying unit 530*a* may be disposed between the intake duct 510 and the discharge duct 520 to be connected to the intake duct 510 and the discharge duct 520.

The drying unit 530*a* may include a condensing duct 560*a*, a dehumidifying unit 1000, and a heating duct 550*a*. The dehumidifying unit 1000 may include a dehumidifying member 546, a rotation transmitting device 543 of the dehumidifying member 546 and a rotation driving device 547.

The condensing duct 560*a* may be connected to the intake duct 510 to fact a lower surface 37 of the washing tub 30.

The condensing duct 560*a* may include a cover 568, a housing 569, and an inlet channel 571.

A condenser 561, the dehumidifying member 546, and the rotation transmitting device 543 of the dehumidifying member 546 may be accommodated inside the condensing duct 560*a*. Particularly, the cover 568 and the housing 569 of the condensing duct 560*a* may be coupled to each other and form an accommodation space 579 in which the condenser 561, the dehumidifying member 546, and the rotation transmitting device 543 of the dehumidifying member 546 are accommodated.

The dehumidifying member 546 may include a dehumidifying area 546*a* and a regenerating area 546*b* separated from the dehumidifying area 546*a* so that the dehumidifying member 546 may perform dehumidifying and regenerating at the same time. Particularly, the dehumidifying area 546*a* of the dehumidifying member 546 may dehumidify air transferred to the drying unit 530*a* through the at least one inlet 511 and transfer dry air to the inside of the washing tub 30. The dehumidifying member 546 having moisture may be regenerated in the regenerating area 546*b* by a heater 551. The dehumidifying member 546 is rotatable so that the dehumidification and the regeneration of the dehumidifying member 546 may be simultaneously performed by turns.

As mentioned above, the dehumidifying member 546 may be rotatable.

The dehumidifying member 546 may receive driving force from a rotation driving device 547 through the rotation transmitting device 543 for the rotation.

The rotation transmitting device 543 may include a dehumidifying member frame 544 and a rotation gear 545.

The dehumidifying member frame 544 may be disposed along a circumference of the dehumidifying member 546 on the outside of the dehumidifying member 546. The dehumidifying member 546 may be integrally rotatable with the dehumidifying member frame 544. The dehumidifying member frame 544 may have a shape and a size corresponding to the dehumidifying member 546. On the outside surface of the dehumidifying member frame 544, one or more teeth 544*a* may be formed.

The rotation gear 545 may be connected to the rotation driving device 547 supplying driving force for the rotation of the dehumidifying member 546. The rotation driving device 547 may be disposed on the outside of the condensing duct 560*a*. The rotation gear 545 may be connected to the rotation driving device 547 by being coupled to a rotation driving shaft 548. The rotation gear 545 may be connected to the dehumidifying member frame 544 to transmit torque to the dehumidifying member 546, and may have a shape corresponding to the tooth 544*a* of the dehumidifying member frame 544. The rotation gear 545 may transmit driving force supplied by the rotation driving device 547 to the dehumidifying member frame 544, and the dehumidifying member 546 may receive driving force from the dehumidifying member frame 544 so that the dehumidifying member 546 may be integrally rotated together with the dehumidifying member frame 544.

The inlet channel 571 may be integrally formed with the cover 568 to be connected to the intake duct 510.

The condenser 561, the dehumidifying member 546, and the rotation transmitting device 543 of the dehumidifying member 546 are accommodated inside the housing 569. Particularly, the condenser 561 may be disposed on an upper portion of a first direction (M), which is air discharged from the intake duct 510 toward a lower side of the washing tub 30. The dehumidifying member 546 and the rotation transmitting device 543 of the dehumidifying member 546 may be disposed at an lower portion of the first direction (M), which is air introduced through the at least one inlet 511 toward a lower side of the washing tub 30. That is, the dehumidifying member 546 and the rotation transmitting device 543 of the dehumidifying member 546 may be disposed at a lower portion of the condenser 561 to face the condenser 561. As mentioned above, when the condenser 561 may be disposed at the upper portion of the first direction (M), which is air discharged from the intake duct 510 toward a lower side of the washing tub 30 and the dehumidifying member 546 may be disposed at the lower portion of the first direction (M), which is air discharged from the intake duct 510 toward a lower side of the washing tub 30, a distance between the heater 551 disposed on a lower portion of the condenser 561 and the dehumidifying member 546 may be increased so that high efficiency condensing may be achieved.

The condenser 561 may be disposed at the upper portion of the first direction (M), which is air discharged from the intake duct 510 toward the lower side of the washing tub 30 to avow a condensate water level generated during exchanging heat to be higher than a water level inside the sump 100 (refer to FIG. 1). When the condensate water level is higher than the water level inside the sump 100 (refer to FIG. 1), condensate water may be discharged by the drain pump 52.

A partition 542*a* may be formed inside the housing 569 so that the dehumidifying member 546 may be divided into the dehumidifying area 546*a* and the regenerating area 546*b*. The partition 542*a* may make contact with the dehumidifying member 546. The partition 542*a* may be integrally formed with the housing 569.

The condenser 561 may be disposed at the front of the dehumidifying member 546. Particularly, the condenser 561 may be disposed at the front of the dehumidifying area 546*a*.

The condenser 561 may include a plurality of tubes 562. The plurality of tubes 562 may be arranged in parallel to each other inside the housing 590. The plurality of tubes 562 may be formed of plastic.

The plurality of tubes 562 of the condenser 561 may form a first flow path 563 and a second flow path 564. Particularly, the first flow path 563 may be disposed between the plurality of tubes 562 so that air discharged from the intake duct 510 flows in the first direction (M) toward a lower side of the washing tub 30, and passes through the condenser 561 to be transferred to the dehumidifying area 546*a*. The second flow path 564 may be disposed inside the plurality of tubes 562 so that air passed through the regenerating area 546*b* passes through the condenser 561 in a second direction (N) perpendicular to the first direction (M), to be transferred to the blowing duct 570.

The first direction (M) and the second direction (N) may cross each other.

The first direction (M) may be perpendicular to the second direction (N).

The first flow path 563 and the second flow path 564 may be separated from each other. Air flowing in the first flow path 563 and air flowing in the second flow path 564 may not be mixed.

A drain pipe 567 may be formed on one side of the condensing duct 560*a*. The drain pipe 567 may be integrally formed with the condensing duct 560*a*. Condensate water generated by exchanging heat between air flowing in the first flow path 563 and air flowing in the second flow path 564 may be discharged to the outside of the condensing duct 560*a* through the drain pipe 567.

The condenser 561 may be tilted so that condensate water may be easily discharged. Particularly, the condenser 561 may be declined toward the drain pipe 567.

The heating duct 550*a* may be disposed on a lower portion of the condensing duct 560*a* in the first direction (M), in which air discharged from the intake duct 510 is toward a lower portion of the washing tub 30.

A compartment 552 may be provided inside the heating duct 550*a*. The compartment 552 together with a partition 542*a* may divide the dehumidifying member 546 into the dehumidifying area 546*a* and the regenerating area 546*b*. In an upper portion of the dehumidifying member 546, the dehumidifying member 546 may be divided into the dehumidifying area 546*a* and the regenerating area 546*b* by the partition 542*a*, and in a lower portion of the dehumidifying member 546, the dehumidifying member 546 may be divided into the dehumidifying area 546*a* and the regenerating area 546*b* by the compartment 552.

The compartment 552 may have a size and a shape corresponding to the partition 542*a*.

The compartment 552 may be disposed between the dehumidifying area 546*a* and the regenerating area 546*b* of the dehumidifying member 546.

The compartment 552 may guide air passed through the heater 551 so that air passed through the heater 551 may be transferred to the dehumidifying area 546*a* of the dehumidifying member 546.

The compartment 552 may be integrally formed with the heating duct 550*a*.

In the compartment 552, a rotation center portion 553 protruding toward the dehumidifying member 546 may be provided. The rotation center portion 553 may be integrally formed with the compartment 552.

The dehumidifying member 546 may be rotated with respect to the rotation center portion 553. The dehumidifying member 546 may be directly or indirectly coupled to the rotation center portion 553. When the dehumidifying member 546 may be indirectly coupled to the rotation center portion 553, a connecting unit 555 may be disposed between the dehumidifying member 546 and the rotation center portion 553. The connecting unit 555 may be coupled to the rotation center portion 553 by penetrating the dehumidifying member 546. The connecting unit 555 together with the dehumidifying member 546 may be rotated with respect to the rotation center portion 553. The connecting unit 555 may be disposed between the dehumidifying member 546 and the rotation center portion 553, the dehumidifying member 546 may be prevented abrasion thereof caused by friction between the dehumidifying member 546 and the rotation center portion 553.

The drying unit 530*a* may further include a return channel 900. The return channel 900 may be disposed on a lower portion of the heating duct 550*a*. The return channel 900 may be disposed between the blowing duct 570*a* and the heating duct 550*a* to connect the blowing duct 570*a* to the heating duct 550*a*.

A heater installing unit 910 in which the heater 551 is installed may be provided inside the return channel 900. The heater 551 may be adjacent to the regenerating area 546*b* to regenerate the regenerating area 546*b* by applying heat to the regenerating area 546*b*. The heater 551 may be disposed on a lower portion of the regenerating area 546*b* to be adjacent to the regenerating area 546*b*. The heater 551 may have a shape and a size corresponding to the regenerating area 546*b*.

In the heater installing unit 910, a heater supplying flow path 920 may be formed. The heater supplying flow path 920 may be disposed on an edge of the heater installing unit 910 so that air passed through the regenerating fan 575 may be transferred to the regenerating area 546*b* of the dehumidifying member 546 through the heater 551.

The heater supplying flow path 920 may be connected to the second channel 573 of the blowing duct 570*a*. The drying unit 530*a* may further include the blowing duct 570*a*. The blowing duct 570*a* may be connected to the discharge duct 520. The blowing duct 570*a* may include a discharge channel 542, a first channel 572, and a second channel 573. Fans 574 and 575 may be accommodated inside the blowing duct 570*a*.

The fans 574 and 575 may include a double suction fan. The fans 574 and 575 may include a centrifugal fan 574 and 575.

The first channel 572 may include a drain pipe 572*b* connected to the discharge channel 542 and an inlet hole 572*a* connected to the return channel 900 and the heating duct 550*a*.

The second channel 573 may include an inlet pipe 573*a* connected to the discharge channel 542, and an outlet pipe 573*b* connected to the return channel 900 and the heating duct 550*a*. Particularly, the outlet pipe 573*b* of the second channel 573 may be connected to the heater supplying flow path 920 formed by coupling the return channel 900 to the heating duct 550*a*.

The inlet channel 571, the first channel 572, and the second channel 573 may be coupled to each other and form an accommodation space 576*a* and 576*b* in which the fans 574 and 575 are accommodated.

The fans 574 and 575 may include a dehumidifying fan 574 and a regenerating fan 575. Particularly, the dehumidifying fan 574 may be accommodated in the dehumidifying fan accommodation space 576*a* formed by coupling the first channel 572, the second channel 573 and the heating duct 550*a* to each other. The regenerating fan 575 may be accommodated in the regenerating fan accommodation space 576*b* provided inside the second channel 573 to be separated from the dehumidifying fan accommodation space 576*a*.

The discharge channel 542 may be disposed among the discharge duct 520, the first channel 572, and the second channel 573 to connect the discharge duct 520 to the dehumidifying fan accommodation space 576*a*. One end portion of the discharge channel 542 may be coupled to the discharge duct 520, and the other end portion of the discharge channel 542 may be coupled to the first channel 572 and the second channel 573. Particularly, the other end portion of the discharge channel 542 may be coupled to the drain pipe 572*b* of the first channel 572 and the inlet pipe 573*a* of the second channel 573.

A thickness of the dehumidifying fan 574 may be greater than that of the regenerating fan 575.

A driving device 590 configured to supply driving force to rotate the fans 574 and 575 may be installed on the outside of the second channel 573. The dehumidifying fan 574 and the regenerating fan 575 may be integrally rotated by being connected to the driving device 590. That is, the dehumidifying fan 574 and the regenerating fan 575 may be integrally rotated with respect to the driving shaft 591 connected to the driving device 590.

The second channel 573 may be coupled to the heating duct 550*a* and the return channel 900. Particularly, the outlet pipe 573*b* of the second channel 573 may be coupled to the heater supplying flow path 920 formed by coupling the return channel 900 to the heating duct 550*a*.

The drying unit 530*a* may further include a connecting channel 580*a*.

The connecting channel 580*a* may connect the condensing duct 560*a* to the blowing duct 570*a*. Particularly, the connecting channel 580*a* may be disposed on the outside of the blowing duct 570*a* to connect the condensing duct 560*a* to the second channel 573 of the blowing duct 570*a*. Air flowing along the second flow path 564 passes through the connecting channel 580*a* and is transferred to the regenerating fan accommodation space 576*b* formed inside the second channel 573.

The drying assembly 500, the washing tub 30 may form a dehumidifying flow path 700 and a regenerating flow path 800, and the description thereof will be described later.

Figure 16:
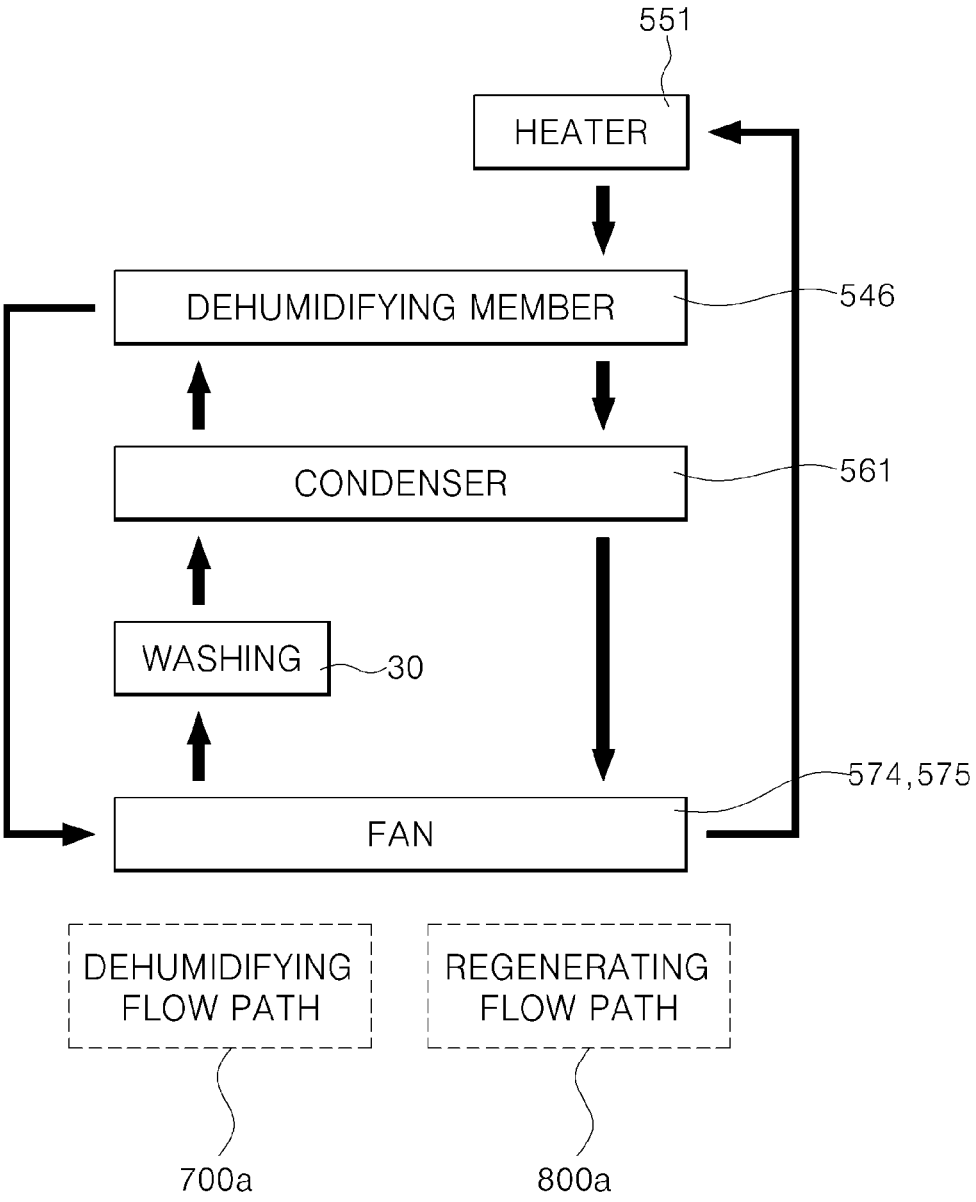
FIG. 16 is a flow chart illustrating a dehumidification and a regeneration of the dishwasher in accordance with another embodiment of the present disclosure.
Figure 17:
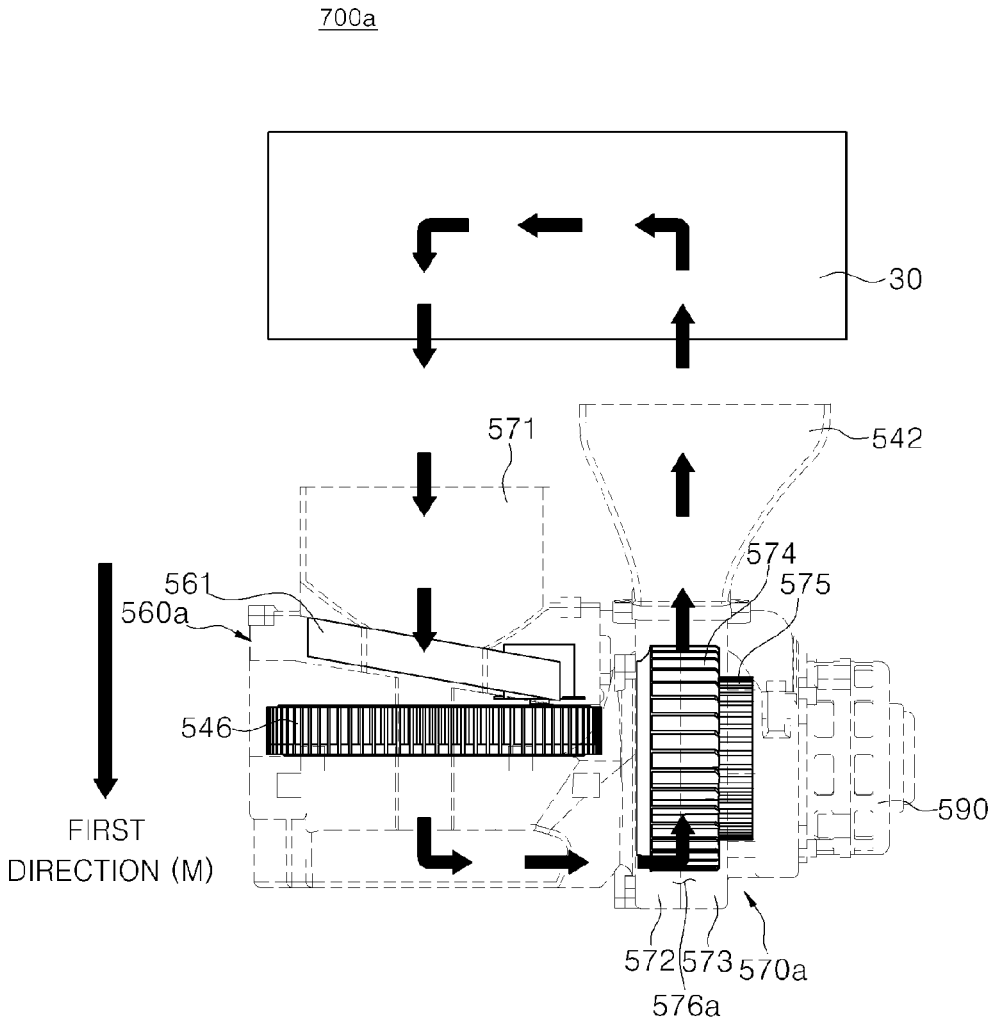
FIG. 17 is a schematic view illustrating a dehumidifying flow path of the dishwasher in accordance with another embodiment of the present disclosure.
Figure 18A:
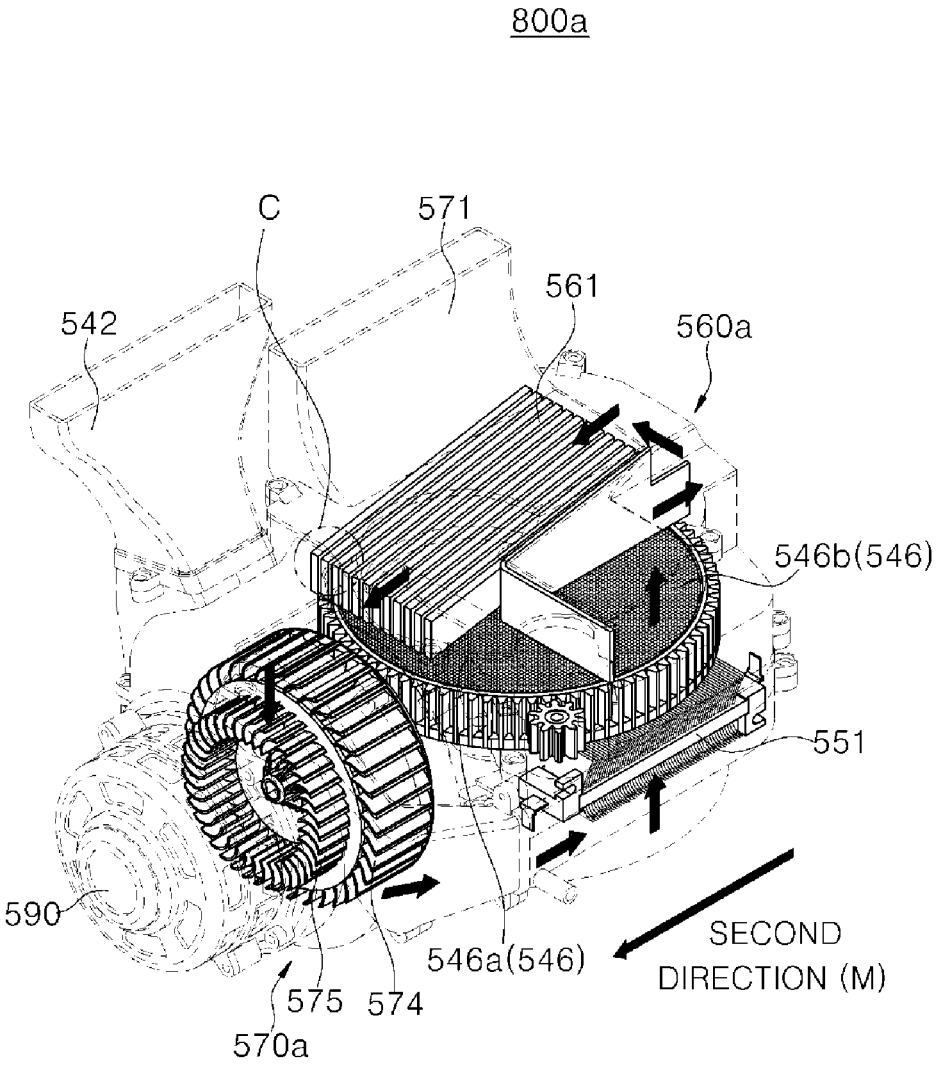
FIG. 18*a* is a view illustrating a regenerating flow path of the dishwasher in accordance with another embodiment of the present disclosure.
Figure 18B:
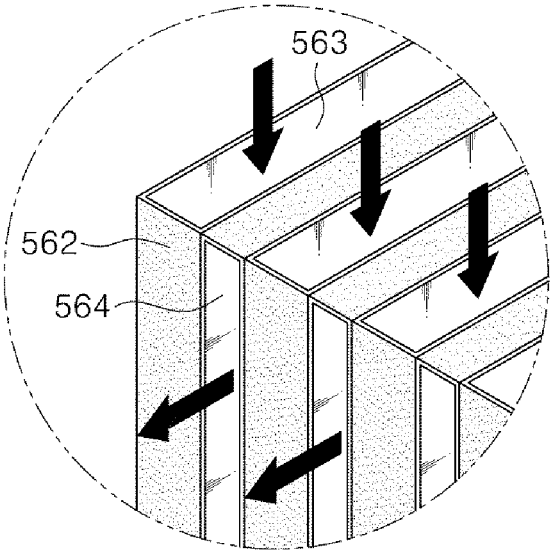
FIG. 18*b* is an enlarged view illustrating a part of FIG. 18*a.*

FIG. 16 is a flow chart illustrating a dehumidification and a regeneration of the dishwasher in accordance with another embodiment of the present disclosure, FIG. 17 is schematic a view illustrating a dehumidifying flow path of the dishwasher in accordance with another embodiment of the present disclosure, FIG. 18*a* is a view illustrating a regenerating flow path of the dishwasher in accordance with another embodiment of the present disclosure, and FIG. 18*b* is an enlarged view illustrating a part of FIG. 18*a*. Hereinafter, reference numerals not shown are referred to in FIGS. 1, 14 and 15.

As illustrated in FIGS. 16 to 18, the dishwasher 1 may include a dehumidifying flow path 700*a* in which air inside the washing tub 30 is circulated and a regenerating flow path 800*a* in which air configured to regenerate the dehumidifying member 546 is circulated.

The dehumidifying flow path 700*a* and the regenerating flow path 800*a* may be separated to prevent each air circulating in the dehumidifying flow path 700*a* and the regenerating flow path 800*a* from being mixed.

The dehumidifying flow path 700*a* and the regenerating flow path 800*a* may form a closed flow path, respectively.

The washing tub 30, the intake duct 510, the first flow path 563 of the condenser 561 (refer to FIG. 18*a*), the dehumidifying area 546*a*, the dehumidifying fan 574, and the discharge duct 520 may be disposed on the dehumidifying flow path 700*a*.

Air inside the washing tub 30, which is passed through the at least one inlet 511 passes the intake duct 510 and is transferred to the condenser 561 accommodated inside the condensing duct 560*a*. Air transferred to the condenser 561 passes through the condensing duct 560, by moving along the first flow path 563 of the condenser 561 and reaches the dehumidifying area 546*a* (refer to FIG. 18*a*). During the time air inside the washing tub 30 passes through the dehumidifying area 546*a*, a sorption phenomena occurs due to a pressure difference between surface pressure of the dehumidifying area 546*a* and vapor pressure contained in air inside the washing tub 30, and moisture contained in air inside the washing tub 30 is transferred to the dehumidifying area 546*a* so that air inside the washing tub 30 is dried. Dry air passed through the dehumidifying area 546*a* is transferred to the dehumidifying fan 574 through the inlet hole 572*a* of the first channel 572. Air transferred to the dehumidifying fan 574 may be discharged to the inside of the washing tub 30 again by passing through the discharge duct 520.

The second channel 573, the regenerating fan 575, the heater 551, the regenerating area 546*b*, and the second flow path 564 of the condenser 561 may be disposed on the regenerating flow path 800*a*.

Air passed through the regenerating fan 575 accommodated inside the second channel 573 passes through the outlet pipe 573*b* of the second channel 573 and flows toward the heater 551 by moving along the heater supplying flow path 920 of the return channel 900. Air passed through the heater 551 reaches the regenerating area 546*b*. Air reaching the regenerating area 546*b* absorbs moisture contained in the regenerating area 546*b*, and is transferred to the condensing duct 560*a*. Air transferred to the condensing duct 560*a* moves along the second flow path 564 and passes through the condenser 561. Air passed through the condenser 561 is transferred to the regenerating fan 575 inside the second channel 573 through the connecting channel 580*a*.

In the condenser 561, the dehumidifying flow path 700*a* and the regenerating flow path 800*a* may be crossed to exchange heat between air circulating in the dehumidifying flow path 700*a* and air circulating in the regenerating flow path 800*a*. During exchanging heat between air circulating in the dehumidifying flow path 700*a* and air circulating in the regenerating flow path 800*a*, condensate water may be generated, and condensate water may be discharged to the outside of the condensing duct 560*a* through the drain pipe 567 formed on the condensing duct 560*a*.

The dehumidifying flow path 700*a* may include at least one between a series flow path and a parallel flow path.

As mentioned above, the series flow path may be formed in a case where the condenser 561 and the dehumidifying member 546 are vertically separated from each other. That is, the series flow path may be formed in a case where a height difference occurs between the condenser 561 and the dehumidifying member 546.

The parallel flow path may be formed in a case where the condenser 561, the dehumidifying member 546 are disposed on the same plane. That is, the parallel flow path may be formed in a case when a height difference does not occur between the condenser 561 and the dehumidifying member 546.

As for the series flow path, air introduced to the condensing duct 560*a* passes through the dehumidifying area 546*a* of the dehumidifying member 546 by passing through the condenser 561 by moving along the first flow path 563.

Alternatively, as for the parallel flow path, one portion of air introduced to the condensing duct 560*a* passes through the condenser 561 by moving along the first flow path 563, and another portion of air introduced to the condensing duct 560*a* passes through the dehumidifying area 546*a* of the dehumidifying member 546. The parallel flow path may have high energy efficiency, but arranging the condenser 561 and the dehumidifying member 546 on the same plane is required so that a width of the condensing duct 560*a* may be increased.

As is apparent from the above description, by using a dehumidifying member capable of rotating and having porous structure, a dehumidifying area may be increased. Dehumidifying and regenerating are performed at the same time so that a drying time may be reduced. By exchanging heat between air circulating a dehumidifying flow path and air circulating a regenerating flow path. Instead of heating wash water, hot air may be transferred to a washing tub so that energy consumption may be reduced. Since hot air generated by exchanging heat between air circulating a dehumidifying flow path and air circulating a regenerating flow path is transferred to a washing tub, a temperature of air transferred to the washing tub may be prevented from increasing excessively, and therefore dishware may be prevented from being damaged during a drying cycle.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher comprising:

a body;

a washing tub inside the body; and a drying unit inside the body, and including a rotatable dehumidifying member, wherein the rotatable dehumidifying member comprises a dehumidifying area and a regenerating area separated from the dehumidifying area to perform dehumidifying and regenerating, respectively.

2. The dishwasher of claim 1, further comprising:

an intake duct coupled to an outer surface of the washing tub and provided with an inlet to allow air inside the washing tub to be introduced and transferred to the dehumidifying area, wherein the drying unit comprises a blowing duct connected to the intake duct, and air discharged from the intake duct is transferred to a dehumidifying fan disposed inside the blowing duct.

3. The dishwasher of claim 2, wherein the drying unit further comprises a condensing duct connected to the blowing duct and configured to accommodate a condenser inside the condensing duct, wherein air passed through the dehumidifying fan is transferred to the dehumidifying area by passing through the condenser in a first direction toward an upper side of the washing tub.

4. The dishwasher of claim 3, further comprising:

a discharge duct connected to an outer surface of the washing tub and provided with an outlet to allow air passed through the dehumidifying area to be discharged to an inside of the washing tub, wherein the drying unit further comprises a drying duct connected to the discharge duct and configured to rotatably accommodate the dehumidifying member.

5. The dishwasher of claim 4, wherein the drying duct comprises a casing disposed on an upper portion of the condensing duct and configured to accommodate the dehumidifying member and a rotation transmitting device of the dehumidifying member, and a discharge channel configured to connect the discharge duct to the casing and provided with a partition extended toward the dehumidifying member to divide the dehumidifying member into the dehumidifying area and the regenerating area.

6. The dishwasher of claim 5, wherein the rotation transmitting device of the dehumidifying member comprises a dehumidifying member frame disposed on an outer circumference of the dehumidifying member and integrally rotated with the dehumidifying member, and a rotation gear coupled to the dehumidifying member frame to transfer torque to the dehumidifying member and coupled to an outside of the discharge channel, wherein teeth are formed on an outer surface of the dehumidifying member frame so that the dehumidifying member frame and the rotation gear may be engaged with each other to rotate the dehumidifying member frame.

7. The dishwasher of claim 4, wherein the drying unit further comprises a heating duct disposed between the drying duct and the condensing duct, wherein a heater having a shape corresponding to the regenerating area is accommodated inside the heating duct to apply heat to the regenerating area.

8. The dishwasher of claim 7, wherein the blowing duct comprises an inlet channel accommodating the dehumidifying fan and connecting the intake duct to the condensing duct, wherein the inlet channel forms a dehumidifying flow path by being connected to the condensing duct so that air introduced through the inlet is discharged to the inside of the washing tub through the outlet by passing the dehumidifying member.

9. The dishwasher of claim 8, wherein the blowing duct further comprises a first channel configured to accommodate the dehumidifying fan and coupled to an outside of the inlet channel to be connected to the heating duct and a second channel coupled to an outside of the first channel to form a regenerating flow path with the first channel.

10. The dishwasher of claim 9, wherein air passed through the first channel is transferred to the regenerating area by passing through the heater to regenerate the dehumidifying member.

11. The dishwasher of claim 10, wherein the drying unit further comprises a connecting channel configured to form the regenerating flow path by connecting the drying duct to the condensing duct.

12. The dishwasher of claim 11, wherein air transferred to the regenerating area passes through the condenser in a second direction perpendicular to the first direction by passing through the connecting channel.

13. The dishwasher of claim 12, wherein the condensing duct comprises a return channel formed along an edge of the condensing duct to provide a plurality of slits on a surface facing the condenser and configured to connect the connecting channel to the second channel, wherein air passed through the condenser in the second direction is introduced to the first channel through the return channel by passing the second channel.

14. The dishwasher of claim 9, wherein the dehumidifying flow path and the regenerating flow path together form a closed flow path.

15. The dishwasher of claim 9, wherein a driving device is mounted to an outside of the second channel, and the dehumidifying fan and the regenerating fan are connected to the driving device to be integrally rotated.

16. The dishwasher of claim 1, wherein an area of the regenerating area is 50% or less than a total area of the dehumidifying member.

17. The dishwasher of claim 1, wherein the dehumidifying member has a porous honeycomb configuration to secure a spacious dehumidifying area.

18. The dishwasher of claim 1, wherein the dehumidifying member is configured to perform dehumidifying and regenerating substantially concurrently.

* * * * *